US007629094B2

(12) United States Patent
Nagai et al.

(10) Patent No.: US 7,629,094 B2
(45) Date of Patent: Dec. 8, 2009

(54) ELECTROPHOTOGRAPHIC PHOTORECEPTOR, AND IMAGE FORMING METHOD, IMAGE FORMING APPARATUS AND PROCESS CARTRIDGE THEREFOR USING THE ELECTROPHOTOGRAPHIC PHOTORECEPTOR

(75) Inventors: Kazukiyo Nagai, Numazu (JP); Tetsuro Suzuki, Fuji (JP); Hiroshi Tamura, Susono (JP); Hongguo Li, Numazu (JP); Tamotsu Horiuchi, Kannami-cho (JP)

(73) Assignee: Ricoh Company, Ltd., Tokyo (JP)

( * ) Notice: Subject to any disclaimer, the term of this patent is extended or adjusted under 35 U.S.C. 154(b) by 582 days.

(21) Appl. No.: 11/317,048

(22) Filed: Dec. 27, 2005

(65) Prior Publication Data

US 2006/0160003 A1 Jul. 20, 2006

(30) Foreign Application Priority Data

Dec. 24, 2004 (JP) ..... 2004-373101
May 13, 2005 (JP) ..... 2005-141686
Jun. 6, 2005 (JP) ..... 2005-164996

(51) Int. Cl.
*G03G 5/047* (2006.01)

(52) U.S. Cl. ..... 430/58.7; 430/58.75; 430/58.85; 430/58.65; 399/159

(58) Field of Classification Search ..... 430/58.7, 430/58.75, 58.85; 399/159
See application file for complete search history.

(56) References Cited

U.S. PATENT DOCUMENTS 4,225,692 A * 9/1980 Turner ..... 526/244
5,492,784 A 2/1996 Yoshikawa et al.
5,583,935 A 12/1996 Dunchock
5,723,243 A 3/1998 Sasaki et al.
5,747,204 A 5/1998 Anzai et al.
5,789,128 A 8/1998 Adachi et al.
5,830,980 A 11/1998 Anzai et al.
5,840,454 A 11/1998 Nagai et al.
5,846,680 A 12/1998 Adachi et al.
5,853,935 A 12/1998 Suzuki et al.
5,871,876 A 2/1999 Ikuno et al.
5,910,561 A 6/1999 Adachi et al.

(Continued)

FOREIGN PATENT DOCUMENTS

EP 0 964 309 A1 12/1999

(Continued)

OTHER PUBLICATIONS

Diamond, Handbook of Imaging Materials, Marcel Dekker, NY, NY 2002, p. 145-164.*

(Continued)

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

An electrophotographic photoreceptor including an electroconductive substrate and a photosensitive layer located overlying the electroconductive substrate, wherein the photosensitive layer comprises units obtained from a radical polymerizing monomer, in which an aliphatic group having two radical polymerizing groups and a charge transporting group including no radical polymerizing group are connected to each other in a single bond, at the surface thereof.

16 Claims, 10 Drawing Sheets

U.S. PATENT DOCUMENTS 5,942,363 A 8/1999 Tanaka et al.
5,976,746 A 11/1999 Tanaka et al.
6,018,014 A 1/2000 Nagai et al.
6,027,846 A 2/2000 Shimada et al.
6,030,733 A 2/2000 Kamai et al.
6,045,959 A 4/2000 Katayama et al.
6,066,428 A 5/2000 Katayama et al.
6,069,224 A 5/2000 Adachi et al.
6,130,310 A 10/2000 Katayama et al.
6,151,468 A 11/2000 Kamai et al.
6,172,176 B1 1/2001 Tanaka et al.
6,180,303 B1 * 1/2001 Uematsu et al. ..... 430/59.6
6,187,492 B1 2/2001 Ri et al.
6,187,494 B1 2/2001 Kawamuara et al.
6,191,249 B1 2/2001 Tanaka et al.
6,194,535 B1 2/2001 Katayama et al.
6,210,848 B1 4/2001 Nagai et al.
6,303,736 B1 10/2001 Kawamura et al.
6,316,577 B1 11/2001 Shimada et al.
6,326,112 B1 12/2001 Tamura et al.
6,444,387 B2 9/2002 Ri et al.
6,486,293 B1 11/2002 Ri et al.
6,492,079 B2 12/2002 Shimada et al.
6,548,216 B2 4/2003 Kawamura et al.
6,576,386 B1 6/2003 Ri et al.
6,596,449 B2 7/2003 Shimada et al.
6,641,964 B2 11/2003 Ikuno et al.
6,664,361 B2 12/2003 Sasaki et al.
6,790,571 B2 9/2004 Kawamura et al.
6,790,572 B2 9/2004 Tamoto et al.
6,844,124 B2 1/2005 Ikuno et al.
6,858,362 B2 2/2005 Tamoto et al.
6,899,983 B2 5/2005 Tamoto et al.
6,919,419 B2 7/2005 Ri et al.
6,936,388 B2 8/2005 Suzuki et al.
6,939,651 B2 9/2005 Li et al.
6,974,654 B2 12/2005 Kawamura et al.
2003/0198881 A1 10/2003 Kawamura et al.
2004/0053152 A1 3/2004 Nagai et al.
2004/0197688 A1 10/2004 Tamoto et al.
2004/0248024 A1 * 12/2004 Suzuki et al. ..... 430/66
2004/0253527 A1 12/2004 Suzuki et al.
2005/0003287 A1 1/2005 Kawamura et al.
2005/0069795 A1 * 3/2005 Jubran et al. ..... 430/72
2005/0100804 A1 5/2005 Tamoto et al.
2005/0158641 A1 7/2005 Yanagawa et al.
2005/0175911 A1 8/2005 Tamoto et al.
2005/0196193 A1 9/2005 Tamoto et al.
2005/0221210 A1 10/2005 Suzuki et al.
2005/0266325 A1 12/2005 Yanagawa et al.
2005/0266328 A1 12/2005 Yanagawa et al.

FOREIGN PATENT DOCUMENTS

JP 56-48637 5/1981
JP 64-1728 1/1989
JP 04-281461 10/1992
JP 05-216249 8/1993
JP 08-262779 10/1996
JP 2000-066425 3/2000
JP 2004-212959 7/2004

OTHER PUBLICATIONS

U.S. Appl. No. 11/500,352, filed Aug. 8, 2006, Toshine, et al.
U.S. Appl. No. 11/562,203, filed Nov. 21, 2006, Nagai, et al.
U.S. Appl. No. 11/561,983, filed Nov. 21, 2006, Sugino, et al.
U.S. Appl. No. 11/563,710, filed Nov. 28, 2006, Inaba, et al.
U.S. Appl. No. 11/616,523, filed Dec. 27, 2006, Fujiwara, et al.
U.S. Appl. No. 11/684,520, filed Mar. 9, 2007, Toshine, et al.
U.S. Appl. No. 11/685,441, filed Mar. 13, 2007, Yanagawa, et al.
U.S. Appl. No. 11/692,682, filed Mar. 28, 2007, Mori, et al.
U.S. Appl. No. 11/750,570, filed May 18, 2007, Ikuno, et al.
U.S. Appl. No. 12/000,239, filed Dec. 11, 2007, Fujiwara, et al.
U.S. Appl. No. 12/035,016, filed Feb. 21, 2008, Iwamoto, et al.
U.S. Appl. No. 12/047,011, filed Mar. 12, 2008, Kami, et al.

* cited by examiner

ELECTROPHOTOGRAPHIC PHOTORECEPTOR, AND IMAGE FORMING METHOD, IMAGE FORMING APPARATUS AND PROCESS CARTRIDGE THEREFOR USING THE ELECTROPHOTOGRAPHIC PHOTORECEPTOR

BACKGROUND OF THE INVENTION

1. Field of the Invention

The present invention relates to an electrophotographic photoreceptor, and to an image forming method, an image forming apparatus and process cartridge therefor using the electrophotographic photoreceptor.

2. Discussion of the Background

Recently, organic photoreceptors (OPCs: organic photo conductors) have been widely used instead of inorganic photoreceptors for copiers, facsimiles, laser printers and their complex machines because of their good performances and advantages. Specific examples of the reasons include (1) optical properties such as a wide range of light absorbing wavelength and a large amount of absorbing light; (2) electrical properties such as high sensitivity and stable chargeability; (3) choice of the materials; (4) good manufacturability; (5) low cost; (6) non-toxicity, etc.

On the other hand, as image forming apparatuses become smaller, photoreceptors have smaller diameters recently. In addition, photoreceptors are required to have high durability as image forming apparatuses produce images at a higher speed and are free from maintenance. In this respect, the organic photoreceptor typically has a soft surface layer mainly formed from a low-molecular-weight charge transport material and an inactive polymer, and therefore the organic photoreceptor typically has a drawback of being mechanically abraded with an image developer and a cleaner with ease when repeated used in the electrophotographic process.

In addition, as toner particles has smaller particle diameters due to requirements for high-quality images, cleaning blades need to have higher rubber hardness and higher contact pressure for the purpose of increasing cleanability, and which also accelerates abrading photoreceptors.

Such abrasions of photoreceptors deteriorate electrical properties thereof such as sensitivities and chargeabilities, and cause abnormal images such as image density deterioration and background fouling. When a photoreceptor is locally abraded, images having black stripes due to defective cleaning are produced. Therefore, the following trials have been made to improve the abrasion resistance.

(1) Japanese Laid-Open Patent Publication No. 56-48637 discloses a photoreceptor using a hardening binder in its surface layer; (2) Japanese Laid-Open Patent Publication No. 64-1728 discloses a photoreceptor using charge transport polymer material; (3) Japanese Laid-Open Patent Publication No. 4-281461 discloses a photoreceptor having a surface layer wherein an inorganic filler is dispersed; (4) Japanese Patent No. 3262488 discloses a photoreceptor having a protection layer including a hardened multifunctional acrylate monomer; (5) Japanese Patent No. 3194392 discloses a method of forming a charge transport layer using a coating liquid formed from a monomer having a carbon-carbon double bond, a charge transport material having a carbon-carbon double bond and a binder resin; and (6) Japanese Laid-Open Patent Publications Nos. 2000-66425 and 2004-212959 disclose a photosensitive layer including a hardened positive hole transport compound having two or more chain polymerizing functional groups in the same molecule.

Although the abrasion resistance has been more improved than that of the conventional photoreceptors thereby, there rises a new problem. The conventional photoreceptors do not produce defective images for long even when having foreign particles or damages on the surface thereof because of being refaced by the abrasion. However, the improved photoreceptors continue to produce defective images for long once having foreign particles or damages on the surface thereof.

Particularly, the recent toners having a smaller particle diameter and a low softening point for producing higher quality images and saving energy include inorganic particulate materials such as silica to improve the fluidity in many cases. The silica occasionally sticks in the surface of the photoreceptor and the toner constituents such as wax accumulate around there, resulting in production of white-spotted defective images.

Furthermore, in order to produce much higher quality images and have higher durability, the photoreceptor needs to have much higher abrasion resistance and much less residual potential.

Because of these reasons, a need exists for a long-life photoreceptor, having good abrasion resistance and electrical properties, and producing less white-spotted defective images.

SUMMARY OF THE INVENTION

Accordingly, an object of the present invention is to provide a long-life electrophotographic photoreceptor, having good abrasion resistance and electrical properties, and producing less white-spotted defective images. Another object of the present invention is to provide along-life photoreceptor capable of accepting blue-violet writing light.

A further object of the present invention is to provide an image forming method producing higher quality images using the photoreceptor.

Another object of the present invention is to provide an image forming apparatus producing higher quality images using the photoreceptor.

A further object of the present invention is to provide a process cartridge for image forming apparatus, producing higher quality images using the photoreceptor.

These objects and other objects of the present invention, either individually or collectively, have been satisfied by the discovery of an electrophotographic photoreceptor comprising units obtained from a radical polymerizing monomer, wherein an aliphatic group having two radical polymerizing groups and a charge transporting group including no radical polymerizing group are connected to each other in a single bond, at the surface thereof.

It is more preferable that the electrophotographic photoreceptor further comprises units obtained from a radical polymerizing monomer having three or more radical polymerizing groups within a molecule.

In addition, it is even more preferable that the electrophotographic photoreceptor furthermore comprises a photo polymerization initiator.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
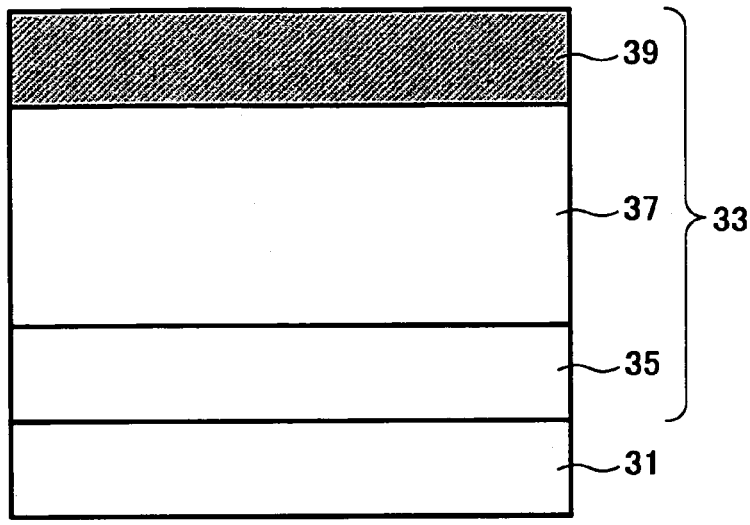
FIG. 1 is across-sectional view of an embodiment of coated layers of the electrophotographic photoreceptor of the present invention.

The present invention provides a long-life electrophotographic photoreceptor, having good abrasion resistance and electrical properties, and producing less white spotted defective images, when including a hardened film formed by polymerizing a specific radical polymerizing monomer at the surface thereof.

The radical polymerizing monomer has both a charge transporting structure and a radical polymerizing structure, and is polymerized to form a charge transporting hardened film. Such radical polymerizing monomers having both a charge transporting structure and a radical polymerizing group have been disclosed in large numbers, e.g., four hundred and several tens of them are disclosed in Japanese Laid-Open Patent Publication No. 2004-212959.

However, these conventional radical polymerizing monomers did not satisfy both of higher abrasion resistance and less residual potential in a high level. The reason is considered to be as follows.

It has been proved that the crosslinked density needs to be fully increased to realize such high abrasion resistance as scarcely has abrasion. Therefore, the content of the radical polymerizing group needs to be increased, the radical polymerizing group needs to be multifunctionalized and the molecular weight of the charge transporting structure needs to be decreased. However, decreasing the molecular weight of the charge transporting structure has a limit to realize good charge transportability. The radical polymerizing group is effectively multifunctionalized to increase the content thereof, but the charge transportability after hardened deteriorates. The reason is not clarified, but it is presumed that many charge transporting parts are crosslinked and the molecular motion thereof is bound be smaller, resulting in deterioration of charge hopping transportability.

The present inventors discovered that a film hardened with units obtained from a radical polymerizing monomer, wherein an aliphatic group having two radical polymerizing groups and a charge transporting group including no radical polymerizing group are connected to each other in a single bond, has both high-density crosslinkage and good charge transportability.

A bulky and immovable aromatic charge transporting group is connected to one part of an aliphatic structure, wherein the molecular motion is comparatively free, in the shape of a pendant so as to be easily rotatable in order to reduce the molecular motion binding of the charge transporting group.

The conventional multifunctional charge transporting monomer has a large distortion when hardened, resulting in a crack and insufficient hardness. However, the radical polymerizing monomer of the present invention is free from crack and sufficiently hardened, and can be used as a good surface layer of a photoreceptor.

In addition, the high-density charge transporting hardened film prevents a hard external additive such as silica from sticking in the surface of the photoreceptor, and the white-spotted defective images can be reduced.

Further, it is preferable to combine units obtained from a radical polymerizing monomer having three or more radical polymerizing groups within a molecule with the above-mentioned radical polymerizing monomer to form the high-density charge transporting hardened film.

Known methods can be used to start polymerization, and a photo polymerization initiator is preferably used to harden the high-density charge transporting layer with light irradiation in a short time, and the resultant photoreceptor has high crosslinked density and mechanical strength.

Specific examples of the radical polymerizing group include known radical polymerizing groups such as a vinyl group, an allyl group, an acryloyloxy group, a methacryloyloxy group and an acrylamide group.

Particularly, the acryloyloxy group or methacryloyloxy group is preferably used in terms of the polymerization properties. The acryloyloxy group or methacryloyloxy group can form a smooth film fully hardened in a short time.

The aliphatic groups are not particularly limited, however, the aliphatic group formed from combination of an alkyl group having 1 to 10 carbon atoms and an ether bond is preferably used.

A preferred embodiment of the aliphatic group having two radical polymerizing groups is a group having the following formula (1):

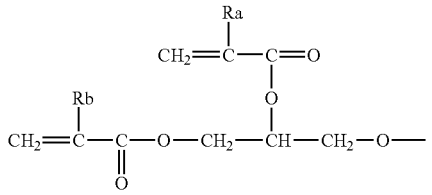

(1)

wherein Ra and Rb each, independently, represent a hydrogen atom or a methyl group.

The group has a good balance of hardening property and flexibility, and is effectively used to achieve a good balance between hardness and charge transportability of the resultant film.

Specific examples of the charge transporting group including no radical polymerizing group include monovalent groups derived from charge transporting compounds including none of the above-mentioned vinyl group, allyl group, acryloyloxy group, methacryloyloxy group and acrylamide group.

The charge transporting compound is a compound transporting a charge generated with light in a photosensitive layer by hopping conduction, etc. The charge transporting compound includes a positive hole transport material and an electron transport material. Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide and diphenoquinone derivatives.

Specific examples of the positive hole transport materials include electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other known materials.

A radical polymerizing monomer having the following formula (2) is preferably used.

(2)

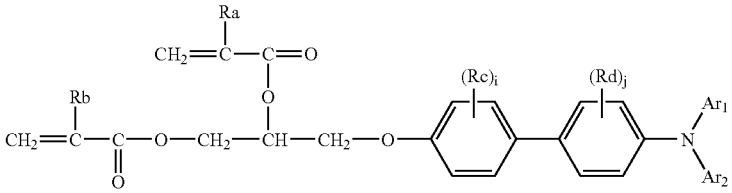

wherein Ra and Rb each, independently, represent a hydrogen atom or a methyl group; Rc and Rd each, independently, represent an alkyl group having 1 to 6 carbon atoms and optionally a substituent, alkoxy group optionally having a substituent or an aryl group optionally having a substituent, or are optionally combined with each other to form a cyclic hydrocarbon ring having 5 to 8 carbon atoms; $Ar_1$ and $Ar_2$ each, independently, represent an aryl group optionally having a substituent; and i and j each, independently, represent 0 or an integer of from 1 to 4.

Further, among the polymerizing monomers having the formula (2), a radical polymerizing monomer having the following formula (3) is more preferably used.

(3)

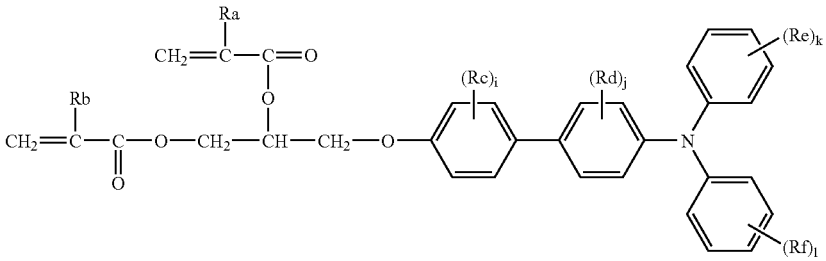

wherein Ra and Rb each, independently, represent a hydrogen atom or a methyl group; Rc, Rd, Re and Rf each, independently, represent an alkyl group having 1 to 6 carbon atoms and optionally a substituent, alkoxy group optionally having a substituent or an aryl group optionally having a substituent, or Rc and Rd are optionally combined with each other to form a cyclic hydrocarbon ring having 5 to 8 carbon atoms; $Ar_1$ and $Ar_2$ each, independently, represent an aryl group optionally having a substituent; i and j each, independently, represent 0 or an integer of from 1 to 4; and k and l each, independently, represent 0 or an integer of from 1 to 5.

In addition, a radical polymerizing monomer having the following formula (4) or (5) can provide a photoreceptor having quite high abrasion resistance and potential stability, and producing less defective images.

(4)

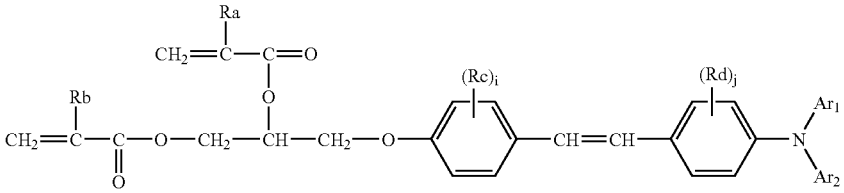

wherein Ra and Rb each, independently, represent a hydrogen atom or a methyl group; Rc and Rd each, independently, represent an alkyl group having 1 to 6 carbon atoms and optionally a substituent, alkoxy group optionally having a substituent or an aryl group optionally having a substituent, or are optionally combined with each other to form a cyclic hydrocarbon ring having 5 to 8 carbon atoms; $Ar_1$ and $Ar_2$ each, independently, represent an aryl group optionally having a substituent; and i and j each, independently, represent 0 or an integer of from 1 to 4.

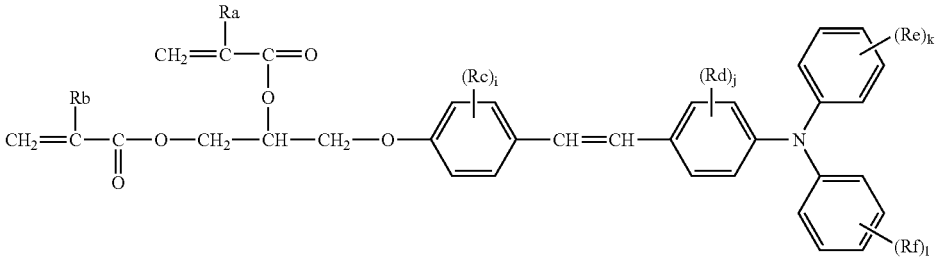

(5)

wherein Ra and Rb each, independently, represent a hydrogen atom or a methyl group; Rc, Rd, Re and Rf each, independently, represent an alkyl group having 1 to 6 carbon atoms and optionally a substituent, alkoxy group optionally having a substituent or an aryl group optionally having a substituent; $Ar_1$ and $Ar_2$ each, independently, represent an aryl group optionally having a substituent; i and j each, independently, represent 0 or an integer of from 1 to 4; and k and l each, independently, represent 0 or an integer of from 1 to 5.

In the formulae (2), (3), (4) and (5), Ra and Rb represent a hydrogen atom or a methyl group. The hydrogen atom or methyl group is selected according to use environment because of having a different polymerizing property each other. Ra and Rb may be the same or different from each other.

Specific examples of the aryl group optionally having a substituent, represented by $Ar_1$ and $Ar_2$, include a phenyl group, a naphthyl group, a biphenylyl group, a terphenylyl group, a pyrenyl group, a fluorenyl group, a 9,9-dimethyl-2-fluorenyl group, an azulenyl group, an anthryl group, a triphenylenyl group, a crycenyl group, a group having the following formulae (6) to (8), etc.

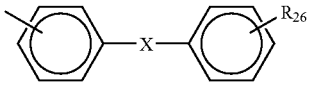

(6)

wherein X represents —O—, —S—, —SO—, —$SO_2$—, —CO—, the following bivalent groups:

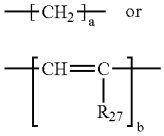

(7)

or (8)

wherein $R_{26}$ and $R_{27}$ each, independently, represent a hydrogen atom, a halogen atom, a substituted or unsubstituted alkyl group or a substituted or unsubstituted aryl group; a represents an integer of from 1 to 12; and b represents an integer of from 1 to 3.

The bivalent groups having the formula (7) or (8) include a halogen atom, alkyl group having 1 to 6 carbon atoms and optionally a substituent and a alkoxy group optionally having a substituent. Specific examples of the halogen atom include a fluorine atom, a chlorine atom, a bromine atom, an iodine atom, etc. Specific examples of the alkyl group having 1 to 6 carbon atoms include a methyl group, an ethyl group, a n-propyl group, an i-propyl group, a t-butyl group, a n-butyl group, an i-butyl group, a n-pentyl group, a n-hexyl group, a cyclohexyl group, etc., and the substituent include a halogen atom and a phenyl group. The alkoxy group optionally having a substituent is an alkoxy group having the above-mentioned alkyl group having 1 to 6 carbon atoms and optionally a substituent, and specific examples thereof include a methoxy group, an ethoxy group, a n-propoxy group, an I-propoxy group, a t-butoxy group, a n-butoxy group, a benzyloxy group, etc.

Rc, Rd, Re and Rf each, independently, represent an alkyl group having 1 to 6 carbon atoms and optionally a substituent, alkoxy group optionally having a substituent or an aryl group optionally having a substituent. Specific examples of the alkyl group having 1 to 6 carbon atoms include a methyl group, an ethyl group, a n-propyl group, an i-propyl group, a t-butyl group, a n-butyl group, an I-butyl group, a n-pentyl group, a n-hexyl group, a cyclohexyl group, etc., and the substituent include a halogen atom and a phenyl group. Specific examples of the alkyl group having 1 to 6 carbon atoms and optionally a substituent include a methyl group, an ethyl group, a n-propyl group, an i-propyl group, a t-butyl group, a n-butyl group, an i-butyl group, a n-pentyl group, a n-hexyl group, a cyclohexyl group, a trifluoromethyl group, a benzyl group, a 4-chlorobenzyl group, 4-methylbenzyl group, etc.

The alkoxy group optionally having a substituent is an alkoxy group having the above-mentioned alkyl group having 1 to 6 carbon atoms and optionally a substituent, and specific examples thereof include a methoxy group, an ethoxy group, a n-propoxy group, an I-propoxy group, a t-butoxy group, a n-butoxy group, a benzyloxy group, etc.

Specific examples of the aryl group optionally having a substituent include a phenyl group, a naphthyl group, a biphenylyl group, a terphenylyl group, a pyrenyl group, a fluorenyl group, a 9,9-dimethyl-2-fluorenyl group, an azulenyl group, an anthryl group, a triphenylenyl group, a crycenyl group, etc.

Specific examples of the substituent include a halogen atoms and an alkyl group having 1 to 6 carbon atoms.

Specific examples of the halogen atom include a fluorine atom, a chlorine atom, a bromine atom, an iodine atom, etc. Specific examples of the alkyl group having 1 to 6 carbon atoms include a methyl group, an ethyl group, a n-propyl group, an i-propyl group, a t-butyl group, a n-butyl group, an i-butyl group, a n-pentyl group, a n-hexyl group, a cyclohexyl group, etc.

In the formulae (2) and (3), Rc and Rd may be combined with each other to form a cyclic hydrocarbon ring having 5 to 8 carbon atoms. Specific examples of the cyclic hydrocarbon ring having 5 to 8 carbon atoms include the following partial structures:

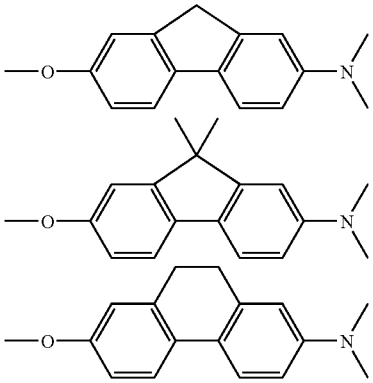

-continued

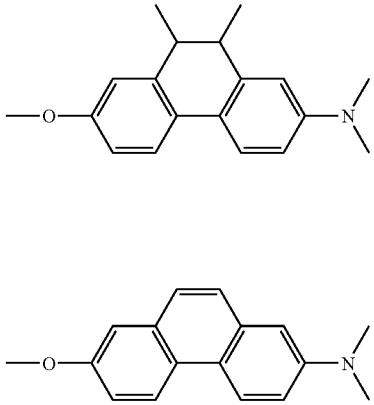

Specific examples of exemplified compounds obtained from the radical polymerizing monomer having the formula (2), wherein Ra is a hydrogen atom and Rb is a methyl group, include the following compounds.

Specific examples of exemplified compounds obtained from the radical polymerizing monomer having the formula (2), wherein Ra is a methyl group and Rb is a hydrogen atom; Ra and Rb are both hydrogen atoms; and Ra and Rb are both methyl groups, can similarly be stated.

No.1

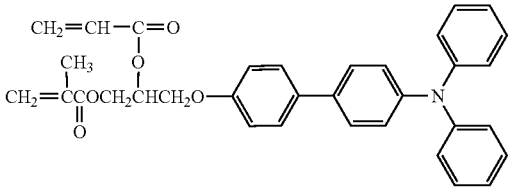

No.2

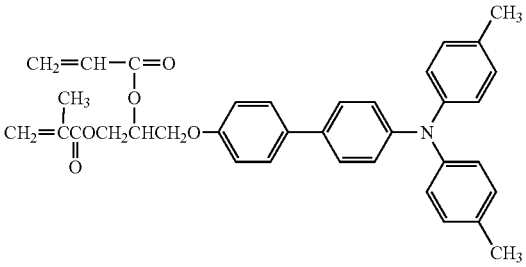

No.3

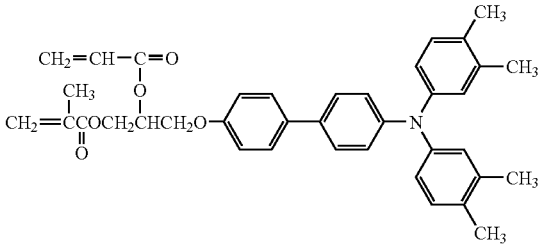

No.4

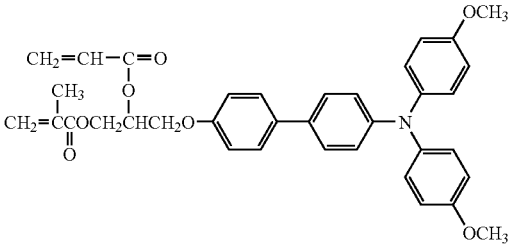

No.5

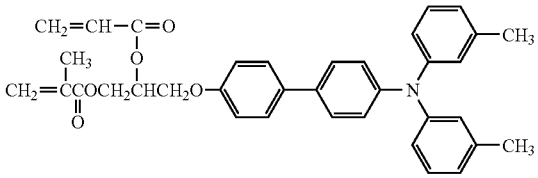

No.6

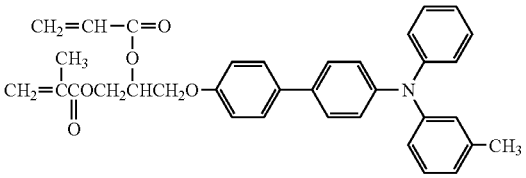

-continued
No.7
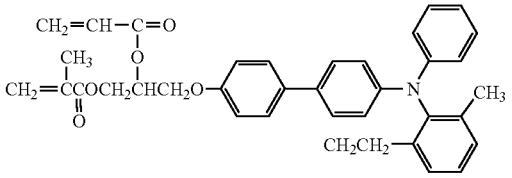
No.8
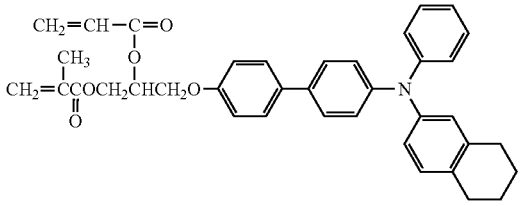
No.9
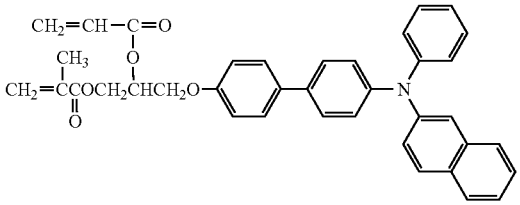
No.10
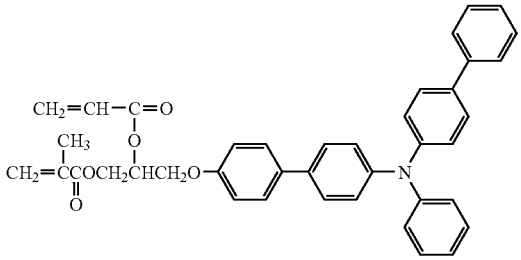
No.11
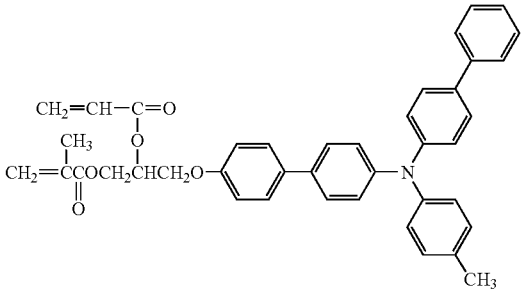
No.12
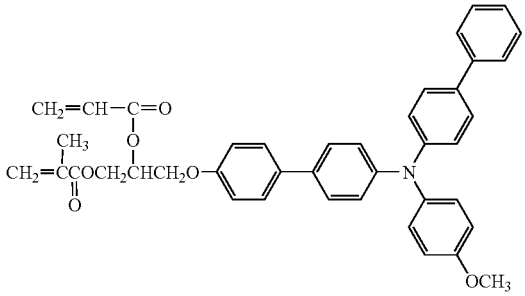
No.13
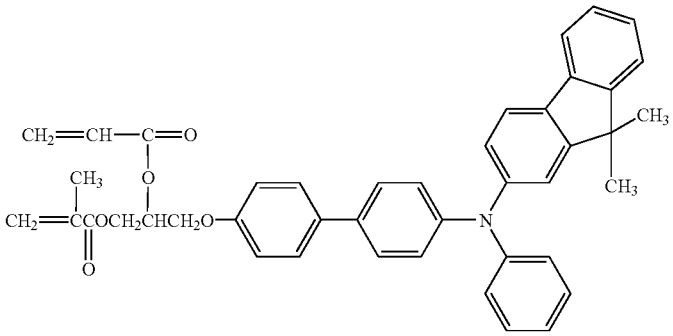
No.14
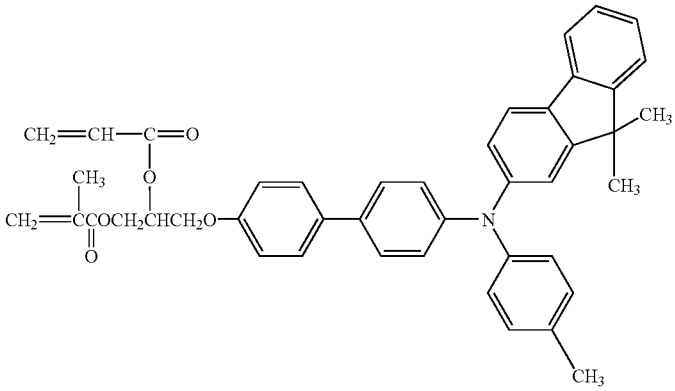

-continued
No.15
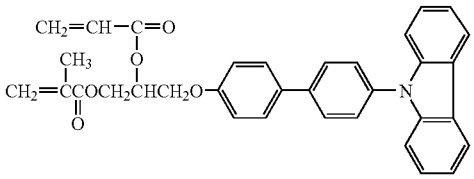
No.16
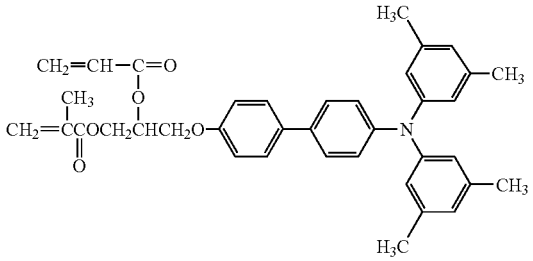
No.17
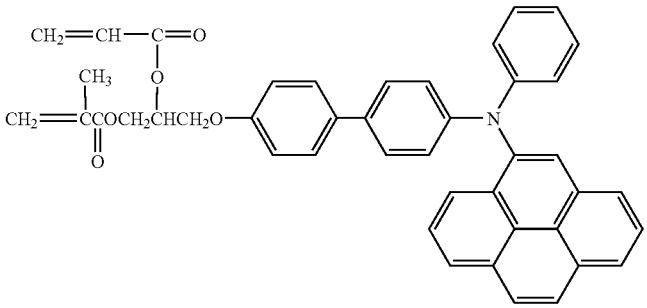
No.18
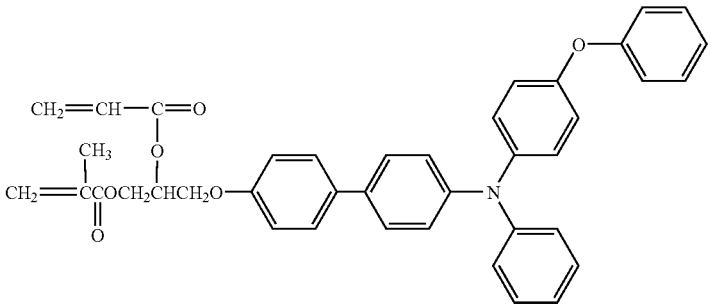
No.19
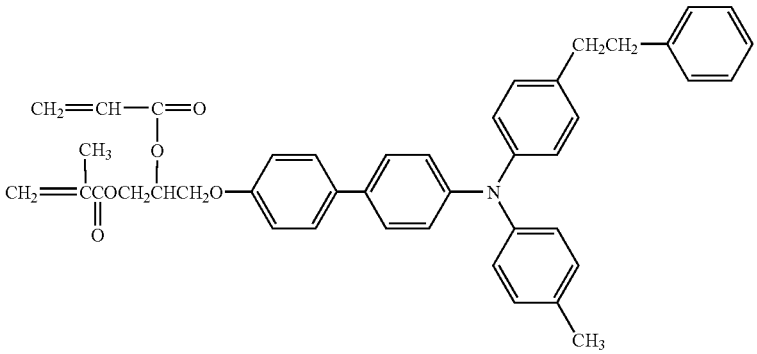

-continued
No.20
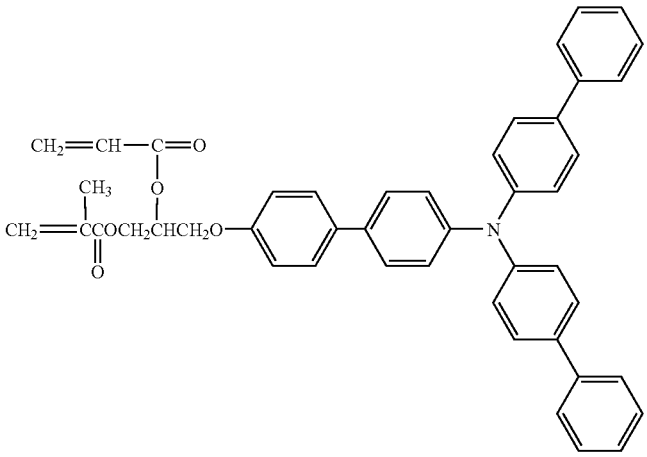
No.21
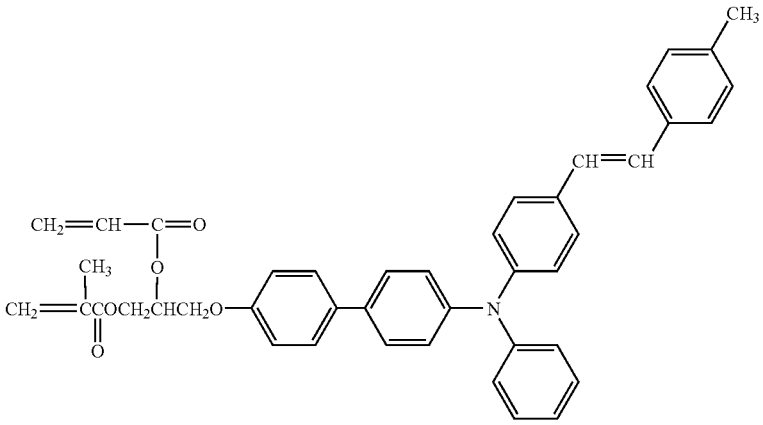
No.22
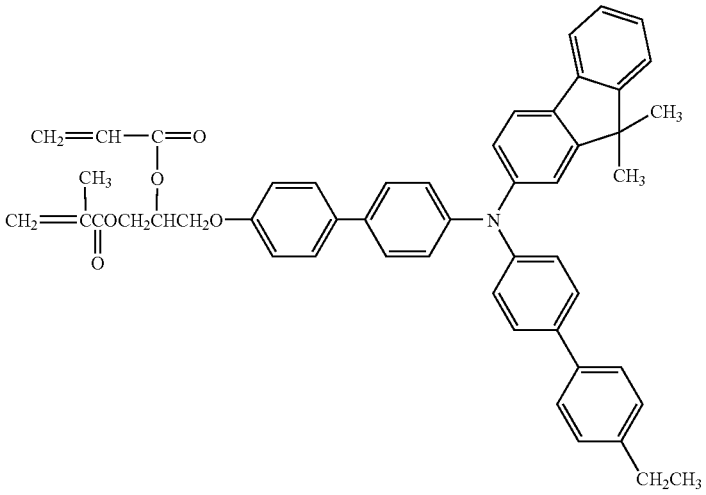

-continued
No.23
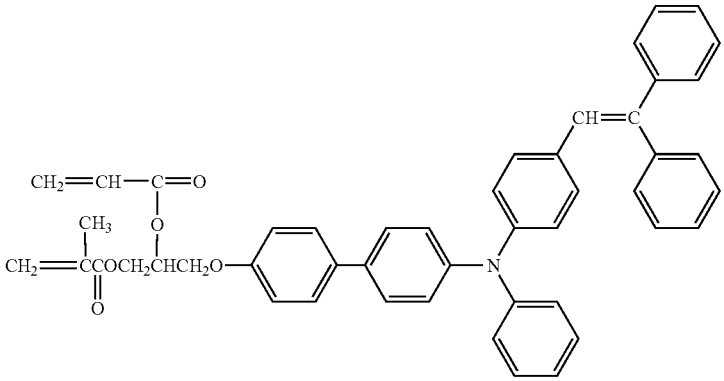
No.24
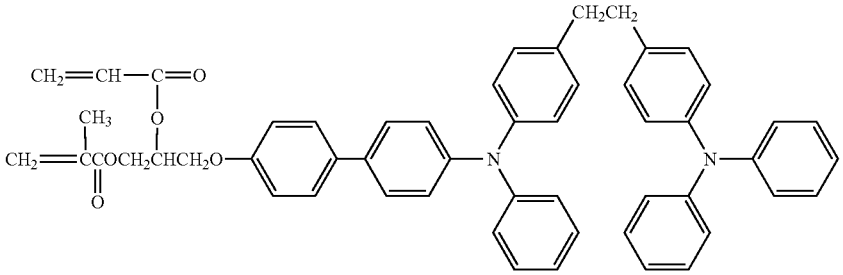
No.25
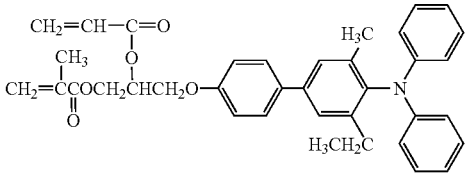
No.26
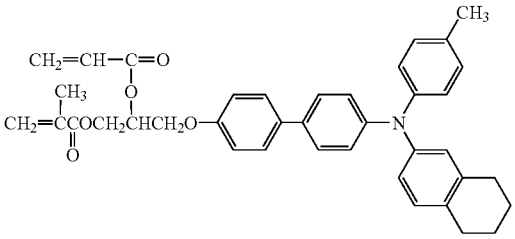
No.27
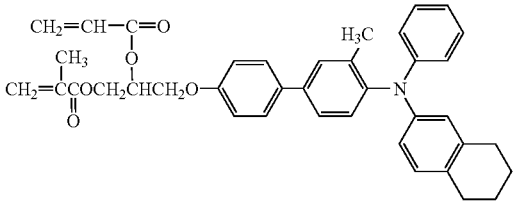
No.28
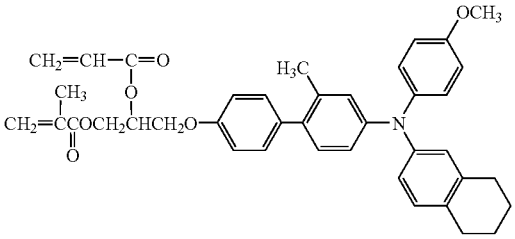
No.29
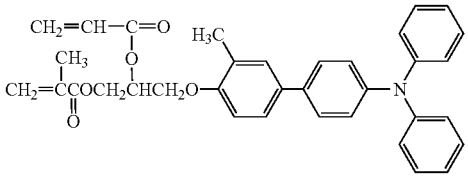
No.30
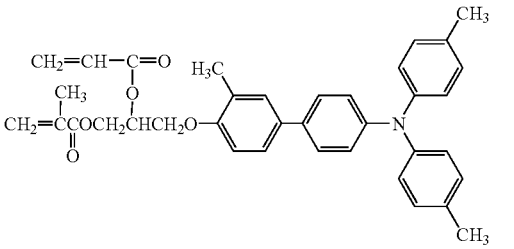

-continued
No.31
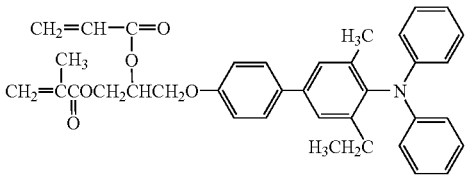
No.32
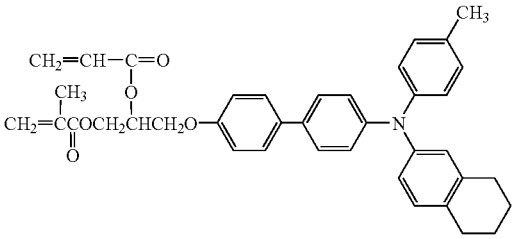
No.33
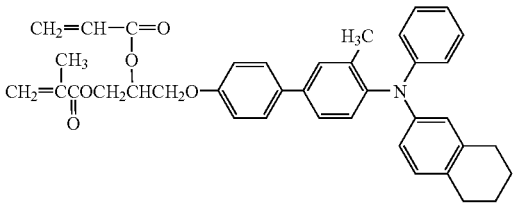
No.34
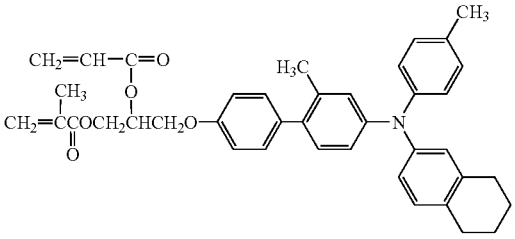
No.35
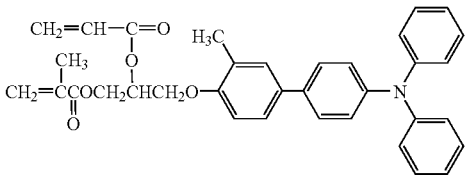
No.36
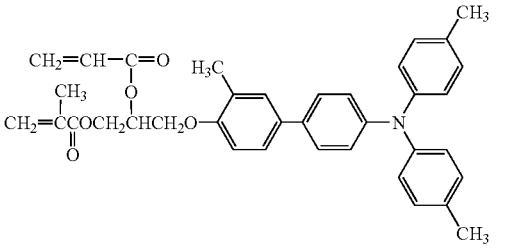
No.37
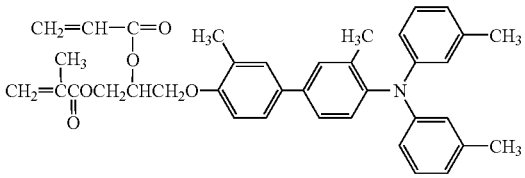
No.38
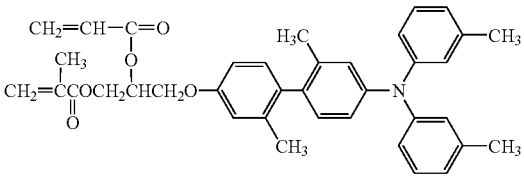
No.39
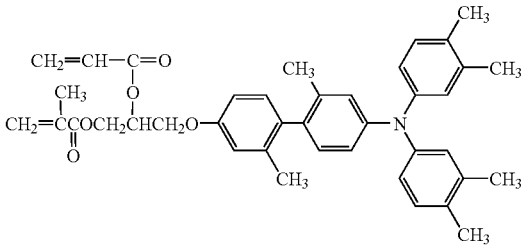
No.40
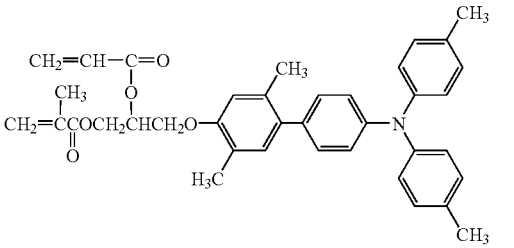
No.41
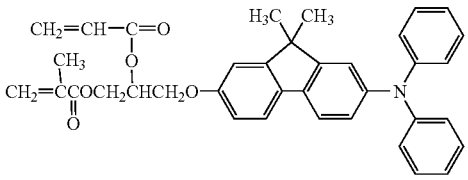
No.42
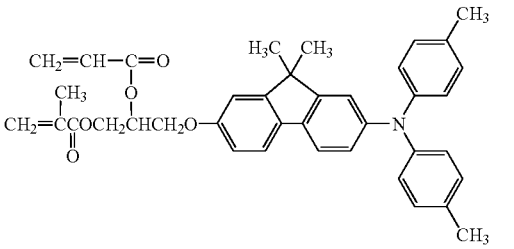

-continued

No.43

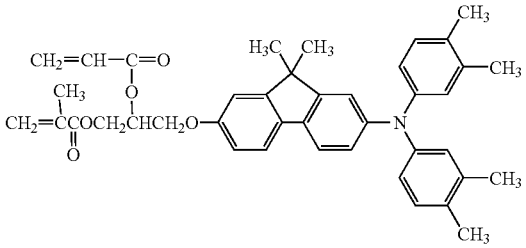

No.44

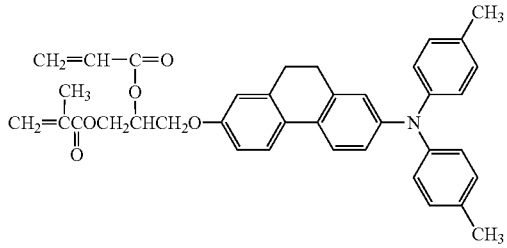

No.45

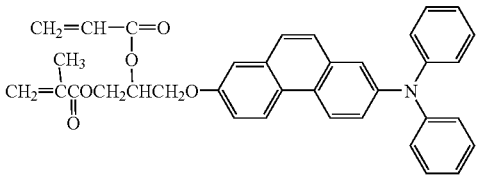

No.46

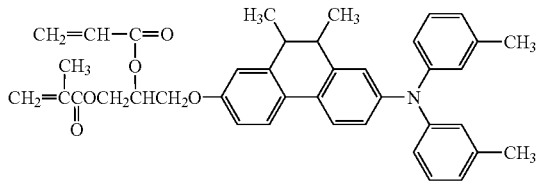

No.47

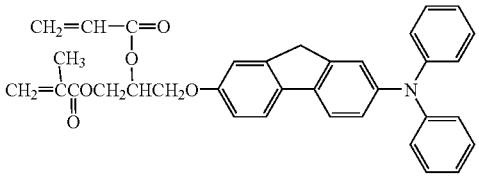

No.48

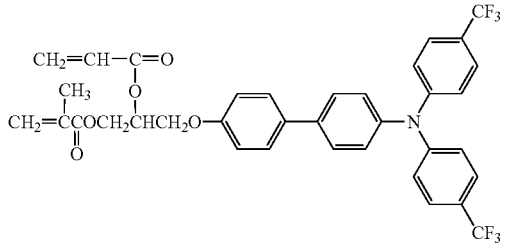

Specific examples of the radical polymerizing monomer having the formula (4), wherein Ra and Rb are hydrogen atoms, include the following radical polymerizing monomers.

Specific examples of the radical polymerizing monomer having the formula (4), wherein Ra is a methyl group and Rb is a hydrogen atom; Ra is a hydrogen atom and Rb is a methyl group; and Ra and Rb are both methyl groups, can similarly be stated.

A =

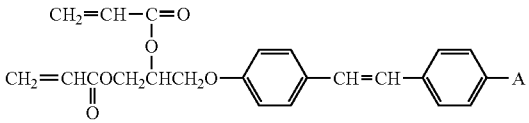

No.1

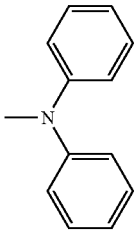

-continued

No.2

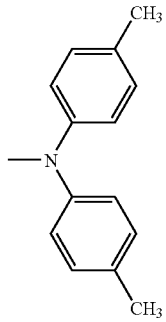

No.3

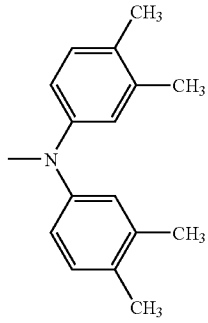

-continued
No.4
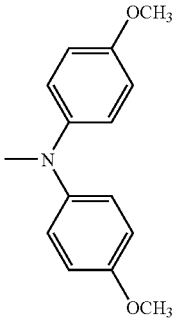
No.5
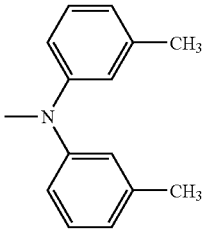
No.6
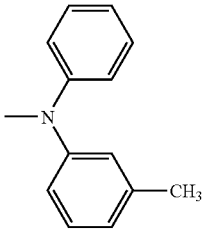
No.7
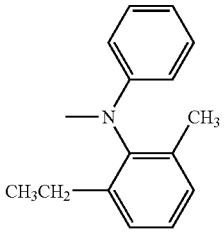
No.8
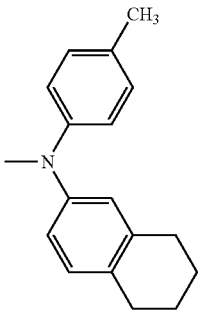
=
-continued
No.9
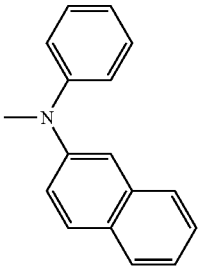
No.10
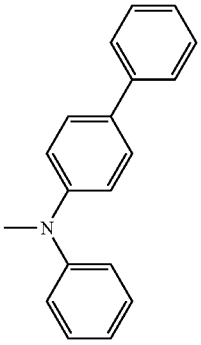
No.11
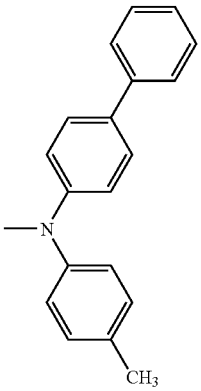
No.12
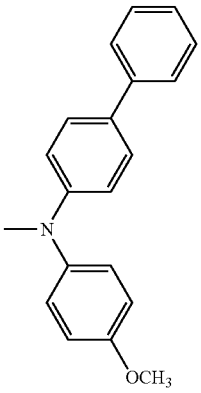

-continued
No.13
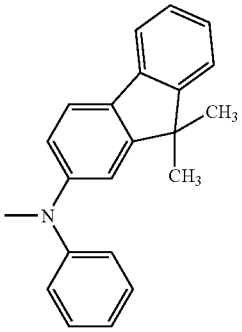
No.14
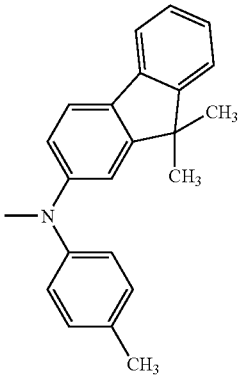
No.15
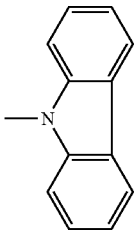
No.16
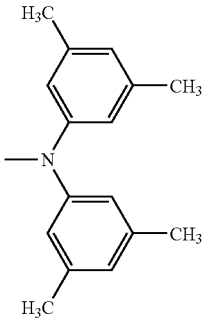
A =
No.17
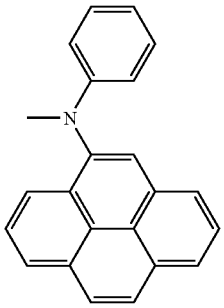
-continued
No.18
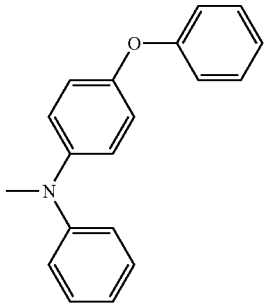
No.19
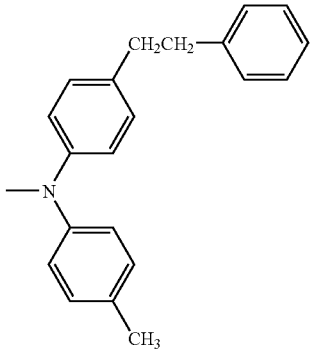
No.20
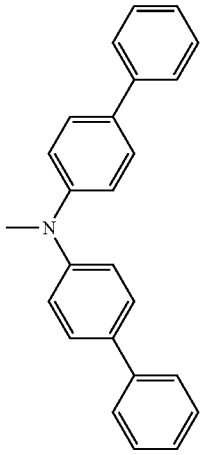
No.21
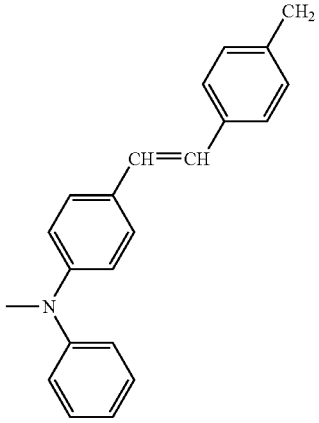

-continued
No.22
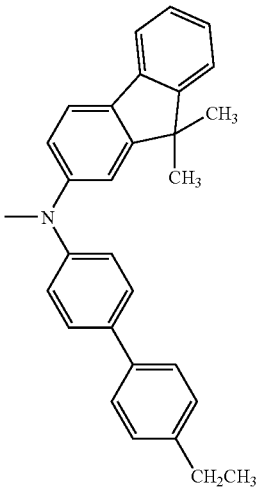
No.23
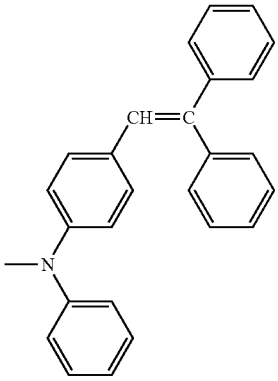
No.24
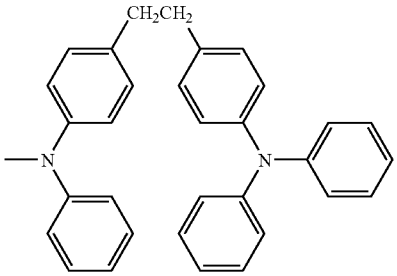
B =
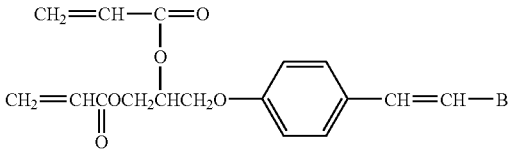
No.25
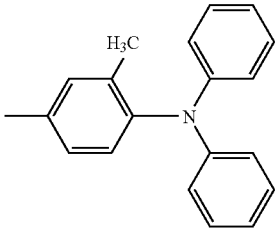
-continued
No.26
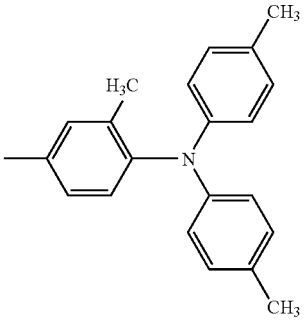
No.27
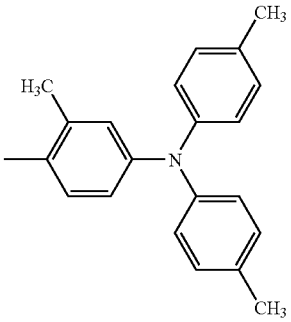
No.28
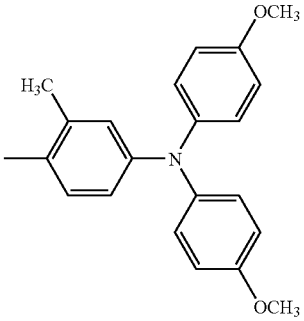
No.29
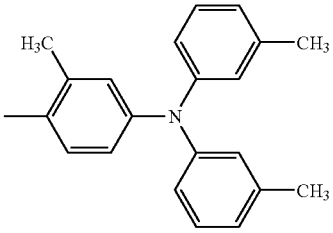
No.30
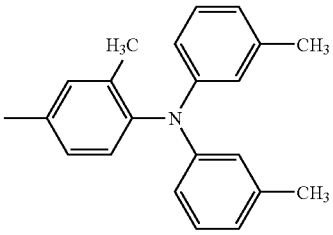

-continued
No.31
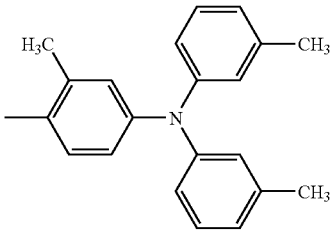
No.32
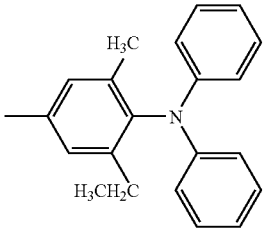
No.33
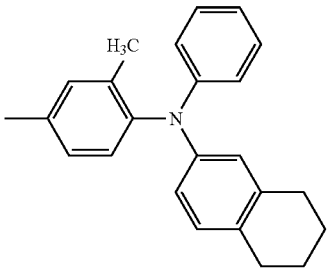
No.34
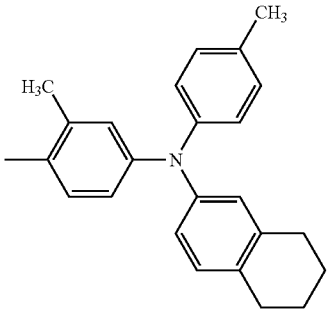
D =
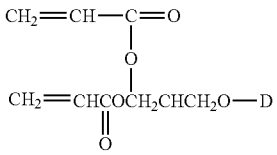
No.35
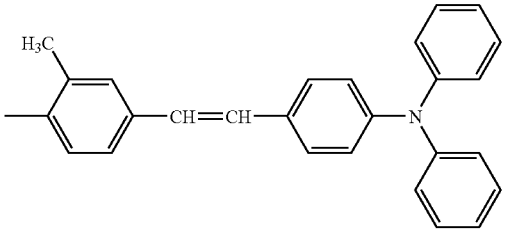
-continued
No.36
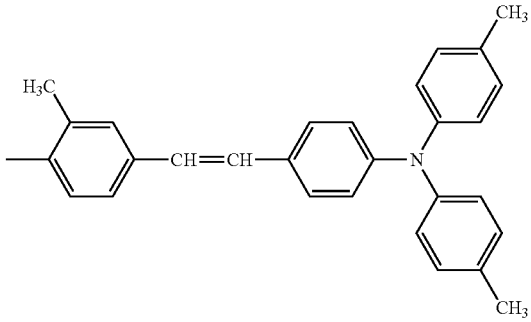
No.37
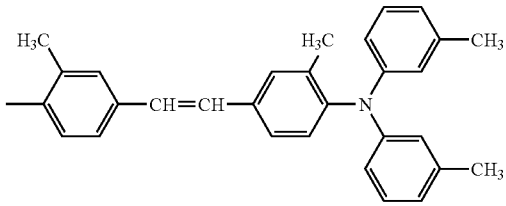
No.38
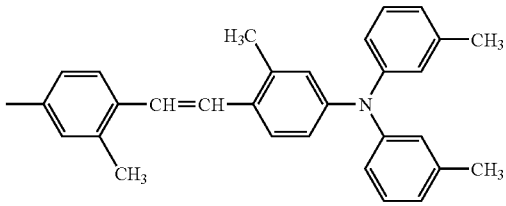
No.39
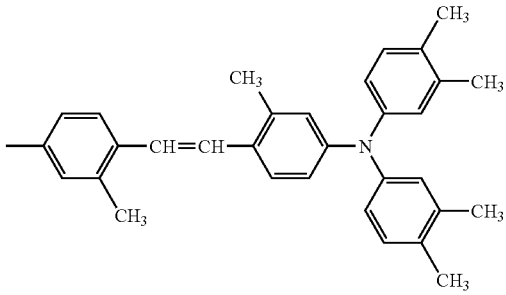
No.40
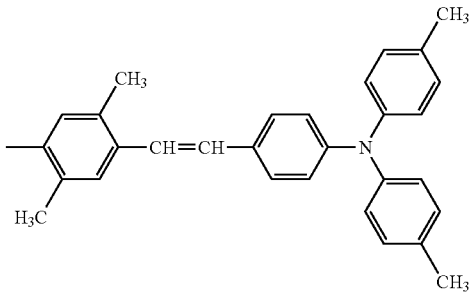
For example, the radical polymerizing monomer having the formula (2) can be synthesized by the following method.

A-1 process
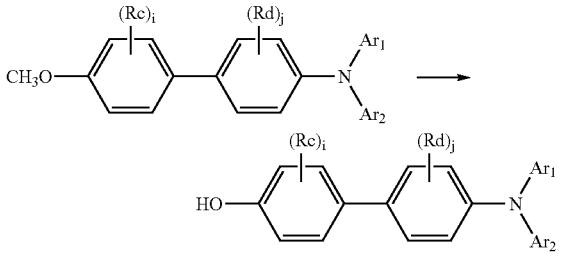
A-2 process
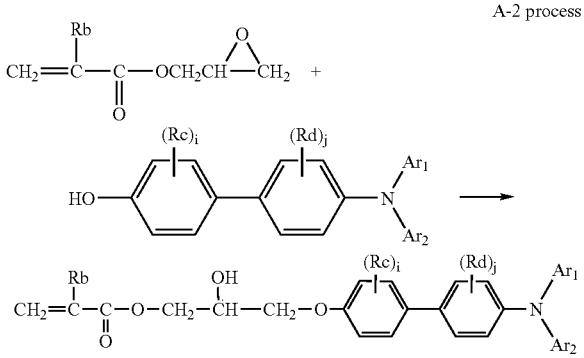
(9)
Then, based on a ring-opening direction of the epoxy ring, the following similar structure is obtained as a by-product.
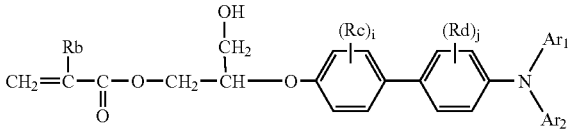
These are not separated easily, and a mixture thereof can be used. The mixture does not affect the property of the resultant product and has a cost advantage.
The A-2 process can be replaced by the following method.
B-1
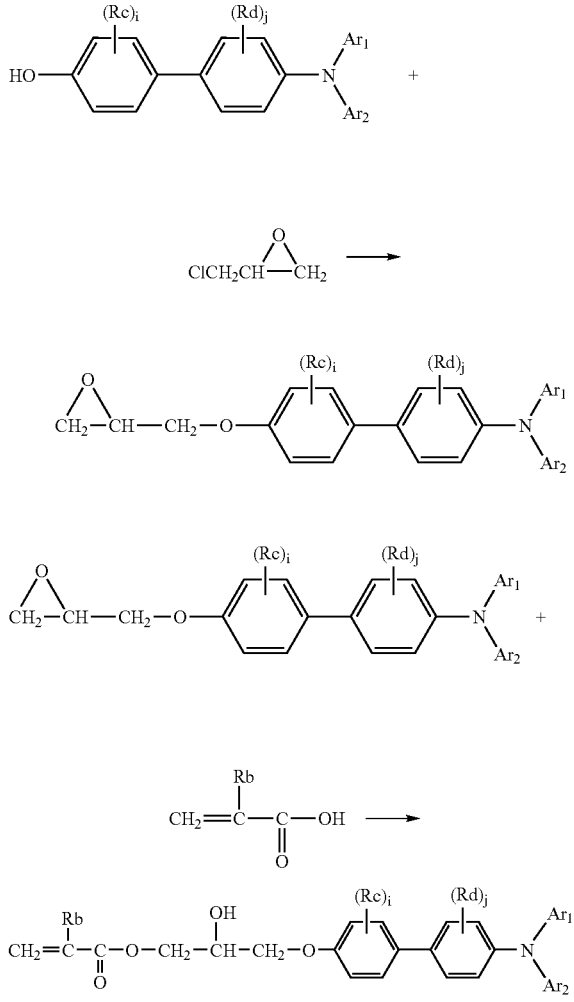
A-3 process
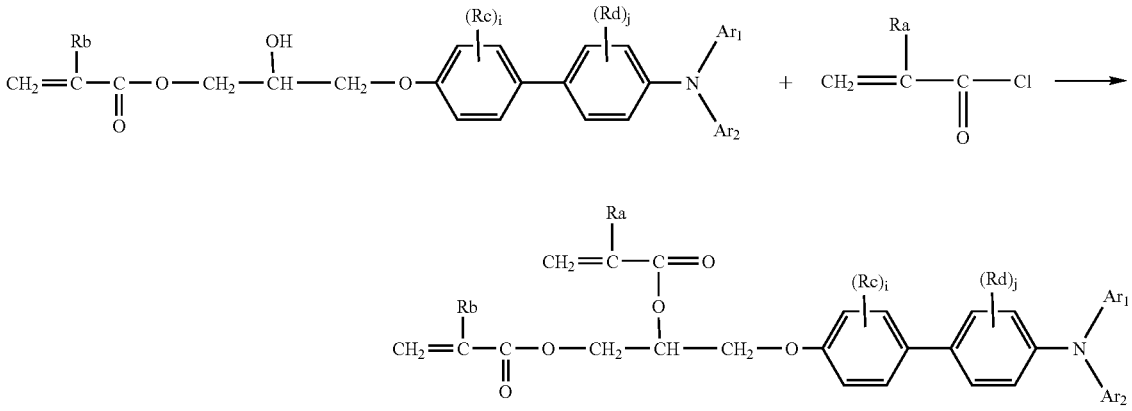

Similarly to the A-2 process, based on a ring-opening direction of the epoxy ring, the following similar structure is obtained as a by-product.

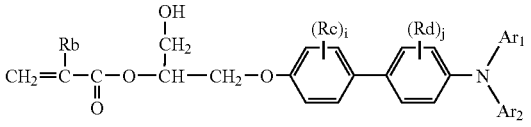

These can also be used as a mixture, and when Ra and Rb are different from each other in the following A-3 process, a mixture of the similar compounds is obtained.

The radical polymerizing monomer having the formula (2) can also be synthesized by hydrolyzing the epoxy compound in the B-1 process or the compound having the formula (9).

C-1 process

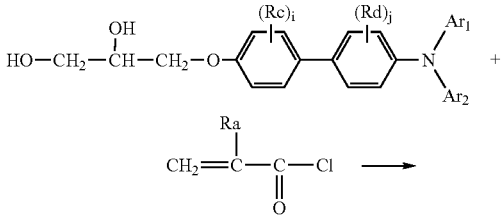

-continued

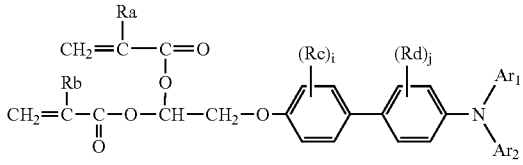

This method can preferably be used when Ra and Rb in the formula (1) are the same.

For example, the radical polymerizing monomer having the formula (4) can be synthesized by the following method.

A′-1 process

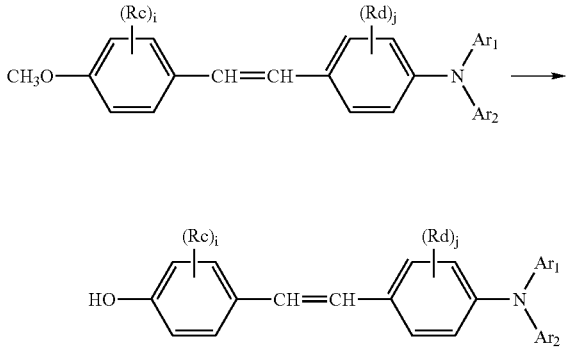

A′-2 process

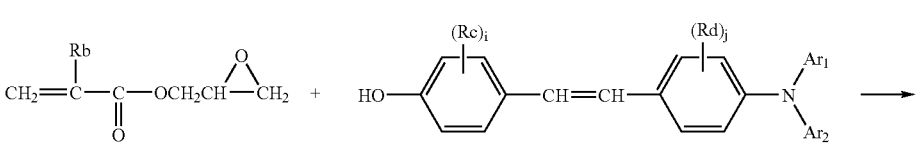

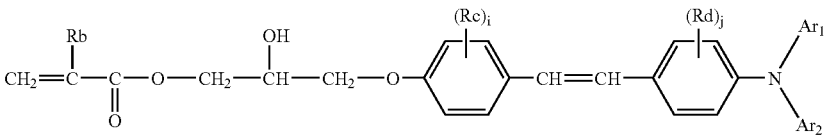

(10)

Then, based on a ring-opening direction of the epoxy ring, the following similar structure is obtained as a by-product.

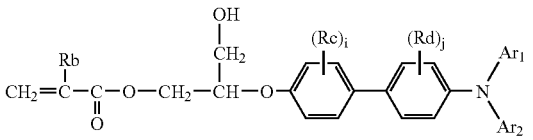

These are not separated easily, and a mixture thereof can be used. The mixture does not affect the property of the resultant product and has a cost advantage.

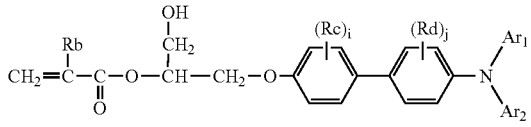

These can also be used as a mixture, and when Ra and Rb are different from each other in the following A'-3 process, a mixture of the similar compounds is obtained.

A'-3 process

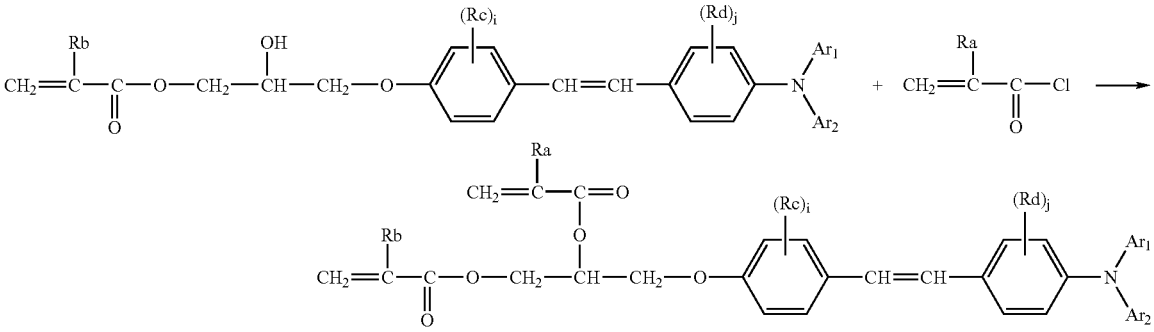

The A'-2 process can be replaced by the following method.

B'-1 process

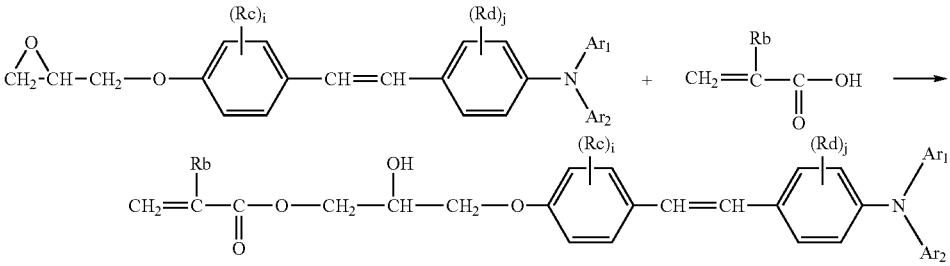

Similarly to the A'-2 process, based on a ring-opening direction of the epoxy ring, the following similar structure is obtained as a by-product.

The radical polymerizing monomer having the formula (4) can also be synthesized by hydrolyzing the epoxy compound in the B'-1 process or the compound having the formula (10).

C'-1 process

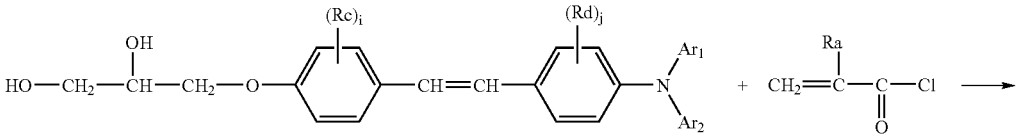

-continued

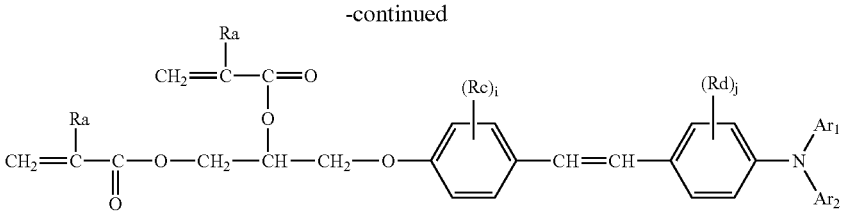

This method can preferably be used when Ra and Rb in the formula (4) are the same.

A-3, A'-3, C-1 and C'-1 processes are acrylating processes, and can be performed as a hydroxy body is esterified. Namely, a (meth)acrylic acid or its ester compound is reacted with an alcohol derivative. For example, an alcohol derivative and a (meth)acrylic acid are heated and stirred with an esterifying catalyst in an organic solvent while dehydrated. Otherwise, an alcohol derivative and chloride acrylate are reacted with each other in an organic solvent under the presence of alkali.

Specific examples of the alkali include alkali aqueous solution such as sodium hydrate and kalium hydrate, and amine bases such as triethylamine and pyridine.

Specific examples of the organic solvent include a hydrocarbon solvent such as toluene, an ether solvent such as tetrahydrofuran and an ester solvent such as ethylacetate.

In addition, in the esterification of the C-1 and C'-1 processes, 3-choridechloropropanate can be used in place of the chloride acrylate to form 3-esterchloropropanate derivative, and which is heated and stirred with a basic catalyst such as triethylamine and hydrogen chloride is removed therefrom to from an esteracrylate derivative. This is a high-yield acrylation.

In this case, N,N-dimethylacetamide is preferably used as a solvent, and the reaction temperature is preferably from 0 to 100° C., and more preferably from 10 to 80° C.

The radical polymerizing monomer having three or more radical polymerizing groups within a molecule is a monomer which neither has a positive hole transport structure such as triarylamine, hydrazone, pyrazoline and carbazole nor has an electron transport structure such as condensed polycyclic quinone, diphenoquinone, a cyano group and an electron attractive aromatic ring having a nitro group, and has three or more radical polymerizing functional groups. Any radical polymerizing functional groups can be used, provided they have a carbon-carbon double bonding and capable of radically polymerizing. Specific examples of the radical polymerizing functional groups include the following (1) 1-substituted ethylene functional groups and (2) 1,1-substituted ethylene functional groups.

(1) Specific examples of the 1-substituted ethylene functional groups include functional groups having the following formula (11):

$$CH_2{=}CH{-}X_1{-} \quad (11)$$

wherein $X_1$ represents a substituted or an unsubstituted phenylene group, an arylene group such as a naphthylene group, a substituted or an unsubstituted alkenylene group, a —CO-group, a —COO-group and a —CON($R_{10}$)-group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group.

Specific examples of the substituents include vinyl groups, styryl groups, 2-methyl-1,3-butadienyl groups, vinylcarbonyl groups, acryloyloxy groups, acryloylamide groups, vinylthioether groups, etc.

(2) Specific examples of the 1,1-substituted ethylene functional groups include functional groups having the following formula (12):

$$CH_2{=}CH(Y){-}X_2{-} \quad (12)$$

wherein $Y_1$ represents a substituted or an unsubstituted alkyl group, a substituted or an unsubstituted aralkyl group, a substituted or an unsubstituted phenyl group, an aryl group such as a naphtyl group, a halogen atom, a cyano group, a nitro group, an alkoxy group such as a methoxy group or a ethoxy group and a —$COOR_{11}$ group wherein $R_{11}$ represents a hydrogen atom, a substituted or an unsubstituted methyl group, an alkyl group such as an ethyl group, a substituted or an unsubstituted benzyl group, an aralkyl group such as a phenethyl group, a substituted or an unsubstituted phenyl group and an aryl group such as a naphtyl group, or a —$CONR_{12}R_{13}$ wherein $R_{12}$ and $R_{13}$ independently represent a hydrogen atom, a substituted or an unsubstituted methyl group, an alkyl group such as an ethyl group, a substituted or an unsubstituted benzyl group, a naphthylmethyl group, an aralkyl group such as a phenethyl group, a substituted or an unsubstituted phenyl group and an aryl group such as a naphtyl group; $X_2$ represents a substituted or an unsubstituted phenylene group, an arylene group such as a naphthylene group, a substituted or an unsubstituted alkenylene group, a —CO-group, a —COO-group, a —CON($R_{10}$)-group wherein $R_{10}$ represents a hydrogen atom, a methyl group, an alkyl group such as an ethyl group, a benzyl group, a naphthylmethyl group, an aralkyl group such as a phenethyl group, a phenyl group and an aryl group such as a naphtyl group, or a —S-group; and at least either Y or $X_2$ is an oxycarbonyl group.

Specific examples of the substituents include α-acryloyloxy chloride groups, methacryloyloxy groups, α-cyanoethylene groups, α-cyanoacryloyloxy groups, α-cyanophenylene groups, methacryloylamino groups, etc. Specific examples of further substituents for the substituents of $X_1$, $X_2$ and Y include halogen atoms, nitro groups, cyano groups, methyl groups, alkyl groups such as ethyl groups, methoxy groups, alkoxy groups such as ethoxy groups, aryloxy groups such as phenoxy groups, phenyl groups, aryl groups such as naphthyl groups, benzyl groups, aralkyl groups such as phenethyl groups. Among these radical polymerizing functional groups, the acryloyloxy groups and methacryloyloxy groups are effectively used. A compound having three or more acryloyloxy groups can be formed by, e.g., performing an ester reaction or an ester exchange reaction among a compound having three or more hydroxyl groups, an acrylic acid (salt), halide acrylate and ester acrylate. A compound having three or more methacryloyloxy groups can be formed by the same method. The radical polymerizing functional groups in a monomer having three or more radical polymerizing functional groups may be the same or different from one another.

Specific examples of the radical polymerizing monomer having three or more radical polymerizing groups include, but are not limited to, the following materials. Namely, trimethylolpropanetriacrylate (TMPTA), trimethylolpropanetrimethacrylate, HPA-modified trimethylolpropanetriacrylate, EO-modified trimethylolpropanetriacrylate, PO-modified trimethylolpropanetriacrylate, caprolactone-modified trimethylolpropanetriacrylate, HPA-modified trimethylolpropanetrimethacrylate, pentaerythritoltriacrylate, pentaerythritoltetraacrylate (PETTA), glyceroltriacrylate, ECH-modified glyceroltriacrylate, EO-modified glyceroltriacrylate, PO-modified glyceroltriacrylate, tris(acryloxyethyl)isocyanurate, dipentaerythritolhexaacrylate (DPHA), caprolactone-modified dipentaerythritolhexaacrylate, dipentaerythritolhydroxypentaacrylate, alkyl-modified dipentaerythritolpentaacrylate, alkyl-modified dipentaerythritoltetraacrylate, alkyl-modified dipentaerythritoltriacrylate, dimethylolpropanetetraacrylate (DTMPTA), pentaerythritolethoxytetraacrylate, 2,2,5,5-tetrahydroxymethylcyclopentanonetetraacrylate, etc. are available. These can be used alone or in combination.

The radical polymerizing monomer having three or more radical polymerizing groups for use in the present invention preferably has a ratio of the molecular weight to the number of functional groups (molecular weight/number of functional groups) in the monomer not greater than 250. When the ratio is greater than 250, the resultant crosslinked material has a rather lowered abrasion resistance, and it is not preferable to use the HPA, EO and PO-modified monomers having extremely long modified groups. The crosslinked material preferably includes the radical polymerizing monomer having three or more radical polymerizing groups in an amount of from 20 to 80% by weight, and more preferably from 30 to 70% by weight. When less than 20% by weight, a three-dimensional crosslinking density of the crosslinked material is insufficient, and the abrasion resistance thereof does not remarkably improve more than a material including a conventional thermoplastic resin. When greater than 80% by weight, a content of a charge transporting compound lowers and electrical properties of the resultant photoreceptor deteriorates. Although it depends on a required abrasion resistance and electrical properties, in consideration of a balance therebetween, a content of the r radical polymerizing monomer having three or more radical polymerizing groups is most preferably from 30 to 70% by weight based on total weight of the crosslinked material.

Specific examples of the photo polymerization initiator include acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-molpholinophenyl)butanone-1,2-hydroxy-2-methyl-1-phenylpropane-1-one and 1-phenyl-1,2-propanedion-2-(o-ethoxycarbonyl)oxime; benzoinether photo polymerization initiators such as benzoin, benzoinmethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds and imidazole compounds.

Further, a material having a photo polymerizing effect can be used alone or in combination with the above-mentioned photo polymerization initiators. Specific examples of the materials include triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone. These polymerization initiators can be used alone or in combination. The surface layer of the present invention preferably includes the polymerization initiators in an amount of 0.5 to 40 parts by weight, and more preferably from 1 to 20 parts by weight per 100 parts by weight of the radical polymerizing compounds.

Next, a method of forming the coated and hardened constituents will be explained.

The coated and hardened constituents for use in the present invention is formed by preparing a coating liquid including at least (A) units obtained from a radical polymerizing monomer wherein an aliphatic group having two radical polymerizing groups and a charge transporting group including no radical polymerizing group are connected to each other in a single bond, (A)+(B) units obtained from a radical polymerizing monomer having three or more radical polymerizing groups within a molecule, or (A)+(B)+(C) a photo polymerization initiator; coating the coating liquid on the surface of a photoreceptor; and irradiating the surface thereof with light to polymerize (A) or (A)+(B). When (A)+(B)+(C) are included, the irradiating is performed with light in compliance with an absorption wavelength of the photo polymerization initiator (C) to polymerize (A) and (B).

The coating liquid can include other components when the radical polymerizing monomer is a liquid, and is optionally diluted with a solvent and coated. Specific examples of the solvent include alcohols such as methanol, ethanol, propanol and butanol; ketones such as acetone, methyl ethyl ketone, methyl isobutyl ketone and cyclohexanone; esters such as ethyl acetate and butyl acetate; ethers such as tetrahydrofuran, dioxane and propylether; halogens such as dichloromethane, dichloroethane, trichloroethane and chlorobenzene; aromatics such as benzene, toluene and xylene; and cellosolves such as methyl cellosolve, ethyl cellosolve and cellosolve acetate. These solvents can be used alone or in combination. A dilution ratio with the solvent can optionally be decided upon solubility of the compositions, a coating method and a purposed layer thickness. The crosslinked surface layer can be coated by a dip coating method, a spray coating method, a bead coating method, a ring coating method, etc.

The constituent (A) is required to impart charge transportability to the resultant hardened and coated constituents, and is preferably included therein in an amount of from 20 to 80% by weight, and more preferably from 30 to 70% by weight. When less than 20% by weight, the hardened and coated constituents have insufficient charge transportability, resulting in deterioration of electrical properties such as lowering sensitivity and increase of residual potential. When greater than 80% by weight, the content of the constituent (B) decreases, resulting in deterioration of crosslinking density.

Besides the constituents (A), (B) and (C), the coating liquid can include a radical polymerizing monomer and a radical polymerizing oligomer having one or two functional groups as well to control a viscosity of the surface layer when coated, reduce a stress of thereof, impart a low surface free energy thereto and reduce friction coefficient thereof. Known radical polymerizing monomers and oligomers can be used. Specific examples of the radical monomer having one functional group include 2-ethylhexylacrylate, 2-hydroxyethylacrylate, 2-hydroxypropylacrylate, tetrahydrofurfurylacrylate, 2-ethylhexylcarbitolacrylate, 3-methoxybutylacrylate, benzylacrylate, cyclohexylacrylate, isoamylacrylate, isobutylacrylate, methoxytriethyleneglycolacrylate, phenoxytetraethyleneglycolacrylate, cetylacrylate, isostearylacrylate, stearylacrylate, styrene monomer, etc. Specific examples of the radical monomer having two functional groups include 1,3-butanediolacrylate, 1,4-butanedioldiacrylate, 1,4-butanedioldimethacrylate, 1,6-hexanedioldiacrylate, 1,6-hexanedioldimethacrylate, diethyleneglycoldiacrylate, neopentylglycoldiacrylate, EO-modified bisphenol A diacrylate, EO-modified bisphenol F diacrylate, etc.

Specific examples of the functional monomers include octafluoropentylacrylate, 2-perfluorooctylethylacrylate, 2-perfluorooctylethylmethacrylate, 2-perfluoroisononylethylacrylate, etc., wherein a fluorine atom is substituted; vinyl monomers having a polysiloxane group having a siloxane repeat unit of from 20 to 70, such as acryloylpolydimethylsiloxaneethyl, methacryloylpolydimethylsiloxaneethyl, acryloylpolydimethylsiloxanepropyl, acryloylpolydimethylsiloxanebutyl and diacryloylpolydimethylsiloxanediethyl disclosed in Japanese Patent Publications Nos. 5-6503 and 6-45770; acrylate; and methacrylate.

Specific examples of the radical polymerizing oligomer includes epoxyacrylate oligomers, urethaneacrylate oligomers and polyetseracrylate oligomers. However, when the coated and hardened constituents includes a large amount of the radical polymerizing monomer and radical polymerizing oligomer having one or two functional groups, the three-dimensional crosslinkage density thereof substantially deteriorates, resulting in deterioration of the abrasion resistance thereof. Therefore, the surface layer of the present invention preferably includes the monomers and oligomers in an amount not greater than 50 parts by weight, and more preferably not greater than 30 parts by weight per 100 parts by weight of the radical polymerizing monomer having three or more functional groups.

Further, the coating liquid may optionally include various additives such as plasticizers (to soften a stress and improve adhesiveness thereof), leveling agents and low-molecular-weight charge transport materials without a radical reactivity. Known additives can be used, and specific examples of the plasticizers include plasticizers such as dibutylphthalate and dioctylphthalate used in typical resins. The content thereof is preferably not greater than 20% by weight, and more preferably not greater than 10% based on total weight of solid contents of the coating liquid. Specific examples of the leveling agents include silicone oil such as dimethylsilicone oil and methylphenylsilicone oil; and polymers and oligomers having a perfluoroalkyl group in the side chain. The content thereof is preferably not greater than 3% by weight.

After the coating liquid is coated, the coating liquid is irradiated to be hardened optionally after dried. Specific examples of the irradiators include UV irradiators such as high pressure mercury lamps and metal halide lamps having an emission wavelength of UV light; and a visible light source adaptable to absorption wavelength of the radical polymerizing compounds and photo polymerization initiators. An irradiation light amount is preferably from 50 to 2,000 mW/cm$^2$. When less than 50 mW/cm$^2$, the crosslinking reaction takes time. When greater than 2,000 mW/cm$^2$, the crosslinked layer has a local wrinkle on the surface and a large inner stress causing a crack and peeling of the layer. When irradiated, nitrogen may substitute oxygen preventing the polymerization. The coating liquid may continuously be irradiated or intermittently be irradiated for plural times.

An electron irradiation which does not need a photo polymerization initiator can also be used for irradiating the coating liquid. However, the light energy is preferably used because it is easy to control the reaction speed therewith.

The more irradiated, the coated and hardened constituents have a higher gel fraction, and become more insoluble and unmeltable. The gel fraction is preferably not less than 95% in the present invention. The gel fraction can be determined by the following formula, measuring a weight loss of the crosslinked material after dipped in an organic solvent having high solubility, such as tetrahydrofuran, for 5 days.

Gel fraction (%)=weight of crosslinked material after dipped and dried/initial weight thereof×100

The coated and hardened constituents are preferably irradiated such that an accumulated irradiation energy becomes not less than 10 J/cm$^2$ to have a gel fraction not less than 95%.

The coated and hardened constituents more preferably have a gel fraction not less than 97% to further prevent an inorganic material such as silica from sticking therein. The accumulated irradiation energy is preferably 20 J/cm$^2$ such that the coated and hardened constituents have a gel fraction not less than 97%.

The coated and hardened constituents are annealed at from 80 to 150° C. for 1 to 60 min after irradiated and hardened to prepare a final electrophotographic photoreceptor.

Next, the constitution of the electrophotographic photoreceptor of the present invention will be explained.

The electrophotographic photoreceptor of the present invention has the coated and hardened constituents at the surface thereof, and a constitution thereof is not particularly limited. However, the coated and hardened constituents are preferably formed at the surface of an organic photoreceptor to negatively be charged because the compounds having the formula (2) and (3) preferred embodiment of the constituent (A) have hole transportability.

The negatively-charged organic photoreceptor typically includes an electroconductive substrate, a charge generation layer thereon and a charge transport layer on the charge generation layer. The charge transport layer can include the coated and hardened constituents. However, a crosslinked charge transport layer including the coated and hardened constituents is preferably formed further on the charge transport layer because the thickness of the charge transport layer is limited due to the hardening conditions when including the coated and hardened constituents.

FIG. 1 is a cross-sectional view of an embodiment of coated layers of the electrophotographic photoreceptor of the present invention, which is a multilayered photoreceptor wherein a photosensitive layer (33) on an electroconductive substrate (31) includes a charge generating charge generation layer (35), a charge transporting charge transport layer (37) thereon and a crosslinked charge transport layer (39) on the charge transport layer (37).

Suitable materials for use as the electroconductive substrate (31) include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Laid-Open Patent Publication No. 52-36016, can also be used as the electroconductive substrate (31). Besides, substrates, in which a coating liquid including a binder resin and an electroconductive powder is coated on the supporters mentioned above, can be used as the electroconductive substrate (31) of the present invention.

Specific examples of such an electroconductive powder include carbon black, acetylene black, powders of metals such as aluminum, nickel, iron, Nichrome, copper, zinc, silver, etc. and metal oxides such as electroconductive tin oxides, ITO, etc.

Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

Further, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be preferably used as the electroconductive substrate (31) of the present invention.

Next, the photosensitive layer (33) will be explained.

The charge transport layer (CGL) (35) is mainly formed of a charge generation material, and optionally includes a binder resin. Suitable charge generation materials include inorganic materials and organic materials. Specific examples of the inorganic charge generation materials include crystalline selenium, amorphous selenium, selenium-tellurium alloys, selenium-tellurium-halogen alloys, selenium-arsenic alloys, amorphous silicone, etc. The amorphous silicone is preferably formed by terminating a dangling bond with a hydrogen atom or a halogen atom, or doping a boron atom or a phosphorus atom.

Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. These charge transport materials can be used alone or in combination.

Specific examples of the binder resin optionally used in the CGL (35) include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination. In addition, a charge transport polymer material can also be used as the binder resin in the CGL besides the above-mentioned binder resins. Specific examples thereof include polymer materials such as polycarbonate resins, polyester resins, polyurethane resins, polyether resins, polysiloxane resins and acrylic resins having an arylamine skeleton, a benzidine skeleton, a hydrazone skeleton, a carbazole skeleton, a stilbene skeleton, a pyrazoline skeleton, etc.; and polymer materials having polysilane skeleton.

Specific examples of the former polymer materials include charge transport polymer materials disclosed in Japanese Laid-Open Patent Publications Nos. 01-001728, 01-009964, 01-013061, 01-019049, 01-241559, 04-011627, 04-175337, 04-183719, 04-225014, 04-230767, 04-320420, 05-232727, 05-310904, 06-234838, 06-234839, 06-234840, 06-234839, 06-234840, 06-234841, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, 09-328539, etc. Specific examples of the latter polymer materials include polysilylene polymers disclosed in Japanese Laid-Open Patent Publications Nos. 63-285552, 05-19497, 05-70595, 10-73944, etc.

The CGL (35) also can include a low-molecular-weight charge transport material. The low-molecular-weight charge transport materials include positive hole transport materials and electron transport materials. Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoquinone derivatives, etc. These electron transport materials can be used alone or in combination.

Specific examples of the positive hole transport materials include electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other known materials. These positive hole transport materials can be used alone or in combination.

Suitable methods for forming the charge generation layer (35) are broadly classified into a vacuum thin film forming method and a solvent dispersion casting method. Specific examples of the former vacuum thin film forming method include a vacuum evaporation method, a glow discharge decomposition method, an ion plating method, a sputtering method, a reaction sputtering method, CVD (chemical vapor deposition) methods, etc. A layer of the above-mentioned inorganic and organic materials can be formed by these methods. The casting method for forming the charge generation layer typically includes preparing a coating liquid by mixing one or more inorganic or organic charge generation materials mentioned above with a solvent such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate, etc., optionally with a binder resin and a leveling agent such as a dimethylsilicone oil and methylphenyl silicone oil, and then dispersing the materials with a ball mill, an attritor, a sand mill, beads mill, etc. to prepare a CGL coating liquid; coating the CGL coating liquid, which is diluted if necessary, on a substrate by a method such as dip coating, spray coating, bead coating and ring coating; and drying the coated liquid to form a CGL. The thickness of the CGL is preferably from about 0.01 to about 5 μm, and more preferably from about 0.05 to about 2 μm.

The charge transport layer (CTL) (37) is a charge-transportable layer, and is formed on the CGL (35) by dissolving or dispersing a charge-transportable charge transport material and a binder resin in a proper solvent to prepare a coating liquid; and coating and drying the liquid on the CGL (35). Specific examples of the charge transport materials include electron transport materials, positive hole transport materials and charge transport polymer materials used in the CGL. Particularly, the charge transport polymer materials are effectively used to reduce a solution of the CTL (37) when the crosslinked CTL (39) is coated thereon.

Specific examples of the binder resins include thermoplastic or thermosetting resins such as polystyrene, styrene-acrylonitrile copolymers, styrene-butadiene copolymers, styrene-maleic anhydride copolymers, polyester, polyvinylchloride, vinylchloride-vinylacetate copolymers, polyvinylacetate, polyvinylidenechloride, polyarylate resins, phenoxy resins, polycarbonate, cellulose acetate resins, ethylcellulose resins, polyvinylbutyral, polyvinylformal, polyvinyltoluene, poly-N-vinylcarbazole, acrylic resins, silicone resins, epoxy resins, melamine resins, urethane resins, phenol resins and alkyd resins. The CTL (37) preferably include the charge transport material in an amount of from 20 to 300 parts by weight, and more preferably from 40 to 150 parts by weight per 100 parts by weight of the binder resin. However, the charge transport polymer material can be used alone or in combination with the binder resin. Specific examples of a solvent used for coating the CTL (37) include the solvents used for coating the CGL (35), and particularly the solvents solving the charge transport material and binder resin well are preferably used. These solvents can be used alone or in combination. The CTL (37) can be formed by the same coating methods used for coating the CGL (35).

In addition, the CTL (37) may optionally include a plasticizer and a leveling agent. Specific examples of the plasticizers include plasticizers for typical resins, such as dibutylphthalate and dioctylphthalate, and the content thereof is preferably from 0 to 30 parts by weight per 100 parts by weight of the binder resin.

Specific examples of the leveling agents include silicone oil such as dimethyl silicone oil and methylphenyl silicone oil; and polymers or oligomers having a perfluoroalkyl group in the side chain, and a content thereof is preferably from 0 to 1 part by weight per 100 parts by weight of the binder resin. The CTL (37) preferably has a thickness of from 5 to 40 μm, and more preferably from 10 to 30 μm. The above-mentioned coating liquid including the constituents (A), (A)+(B) or (A)+(B)+(C) of the present invention is coated on the CTL (37) to form the crosslinked CTL (39) thereon.

The photoreceptor of the present invention can have an intermediate layer between the CTL (37) and the crosslinked CTL (39). The intermediate layer prevents components of the lower CTL (37) from mixing in the crosslinked CTL (39) and improves the adhesiveness therebetween. Therefore, the intermediate layer is preferably insoluble or hardly-soluble with the crosslinked CTL coating liquid and typically includes a binder resin as a main component. Specific examples of the resin include polyamides, alcohol-soluble nylons, water-soluble polyvinyl butyral, polyvinyl butyral, polyvinyl alcohol, etc. The intermediate layer can be formed by one of the above-mentioned known coating methods. The intermediate layer preferably has a thickness of from 0.05 to 2 μm.

The photoreceptor of the present invention may have an undercoat between the electroconductive substrate (31) and the photosensitive layer (33). The undercoat layer includes a resin as a main component. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor. The undercoat layer can also be formed by coating a coating liquid using a proper solvent and a proper coating method similarly to those for use in formation of the photosensitive layer mentioned above.

The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. Besides these materials, known materials can be used. The thickness of the undercoat layer is preferably from 0 to 5 μm.

In the present invention, an antioxidant can be included in each of the layers, i.e., the crosslinked surface layer, charge generation layer, charge transport layer, undercoat layer and intermediate layer to improve the stability to withstand environmental conditions, namely to avoid decrease of photosensitivity and increase of residual potential.

Specific examples of the antioxidant for use in the present invention include the following compound.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(31, 5'-di-t-butyl-4'-hydroxyphenyl)propionate]methane, bis[3,3'-bis(4'-hydroxy-3'-t-butylphenyl)butyric acid]glycol ester, tocophenol compounds, etc.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(d) Organic Sulfur-Containing Compounds

Dilauryl-3,3'-thiodipropionate, distearyl-3,3'-thiodipropionate, ditetradecyl-3,3'-thiodipropionate, etc.

(e) Organic Phosphorus-Containing Compounds

Triphenylphosphine, tri(nonylphenyl)phosphine, tri(dinonylphenyl)phosphine, tricresylphosphine, tri(2,4-dibutylphenoxy)phosphine, etc.

These compounds are known as antioxidants for rubbers, plastics, fats, etc., and marketed products thereof can easily be obtained. Each of the layers preferably includes the antioxidant in an amount of from 0.01 to 10% by weight based on total weight thereof.

The crosslinked CTL (39) (=a layer including the coated and hardened constituents) of the present invention preferably has a thickness of from 1 to 10 μm, and more preferably from 3 to 10 μm. When thicker than 10 μm, the crosslinked CTL is liable to be cracked or peeled, and difficult to have a high crosslinking density because the photopolymerization initiator is difficult to initiate the radical polymerization in the depth. The radical polymerization is liable to be impaired with oxygen, and the surface contacting the atmospheric air is not crosslinked well or nonuniformly crosslinked due to the oxygen radical trap. This frequently happens when the thickness is less than 1 μm. The charge transport components from the under CTL mix therein, and pervade the crosslinked CTL when thin, resulting in prevention of the polymerization and deterioration of the crosslinking density. Therefore, the crosslinked CTL preferably has a thickness not less than 1 μm, and more preferably not less than 3 μm for a longer life of the resultant photoreceptor.

Next, the image forming method and image forming apparatus of the present invention will be explained in detail, referring to the drawings. The image forming method and image forming apparatus of the present invention include a multilayered photoreceptor having a highly abrasion resistant and damage resistant crosslinked CTL being difficult to be cracked and peeled, wherein the photoreceptor is charged and irradiated with imagewise light to form an electrostatic latent image thereon; the electrostatic latent image is developed to form a toner image; the toner image is transferred onto an image bearer (transfer sheet) and fixed thereon; and a surface of the photoreceptor is cleaned. The process is not limited thereto in such a method as to directly transfer an electrostatic latent image onto a transfer sheet and develop the electrostatic latent image thereon.

Figure 2:
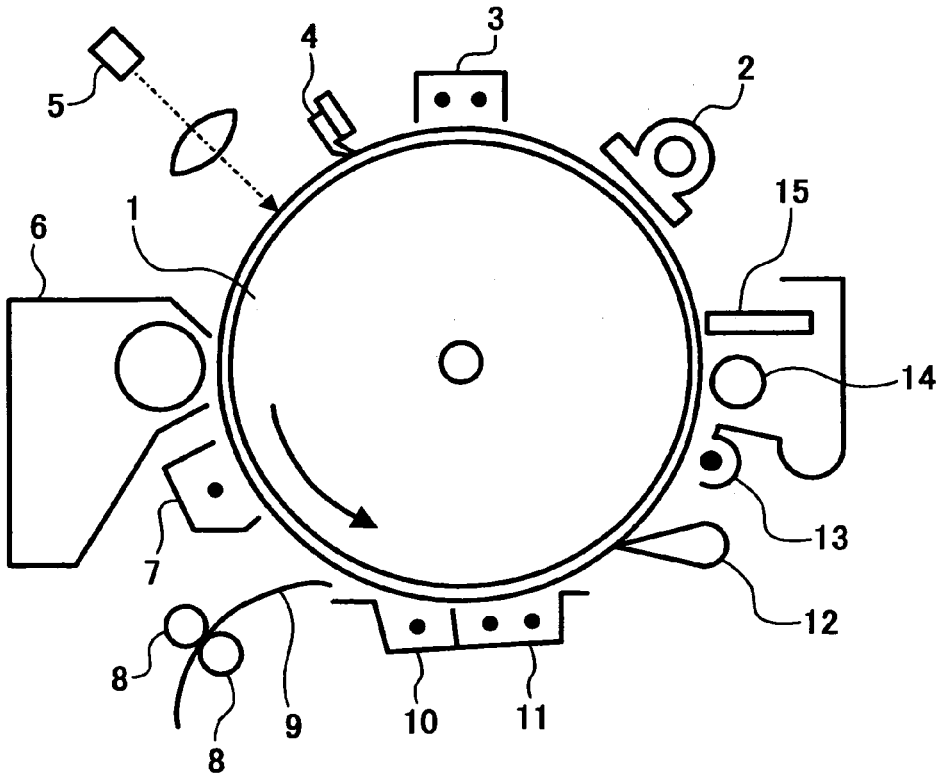
FIG. 2 is a schematic view illustrating a partial cross-section of an embodiment of the image forming apparatus of the present invention.

FIG. 2 is a schematic view illustrating a partial cross-section of an embodiment of the image forming apparatus of the present invention. A charger (3) is used to uniformly charge a photoreceptor 1. Specific examples of the charger include known chargers such as corotron devices, scorotron device, solid state chargers, needle electrode devices, roller charging devices and electroconductive brush devices.

Contact chargers or non-contact chargers can be used in the present invention. The contact chargers include a charging roller, a charging brush, a charging blade, etc. directly contacting a photoreceptor. The non-contact chargers include, e.g., a charging roller located close to a photoreceptor with a gap not longer than 200 μm therebetween. When the gap is too long, the photoreceptor is not stably charged. When too short, the charging member, e.g., a charging roller is contaminated with a toner remaining on the photoreceptor. Therefore, the gap preferably has a length of from 10 to 200 μm, and more preferably from 10 to 100 μm. Next, an imagewise irradiator (5) is used to form an electrostatic latent image on the photoreceptor (1). Suitable light sources thereof include typical light emitters such as fluorescent lamps, tungsten lamps, halogen lamps, mercury lamps, sodium lamps, light emitting diodes (LEDs), laser diodes (LDs), light sources using electroluminescence (EL), etc. In addition, to obtain light having a desired wave length range, filters such as sharp-cut filters, band pass filters, near-infrared cutting filters, dichroic filters, interference filters and color temperature converting filters can be used. Next, a developing unit (6) is used to visualize an electrostatic latent image formed on the photoreceptor (1). The developing methods include a one-component developing method and a two-component developing method using a dry toner; and a wet developing method using a wet toner. When the photoreceptor positively or negatively charged is exposed to imagewise light, an electrostatic latent image having a positive or negative charge is formed on the photoreceptor. When the latent image having a positive charge is developed with a toner having a negative charge, a positive image can be obtained. In contrast, when the latent image having a positive charge is developed with a toner having a positive charge, a negative image can be obtained. Next, a transfer charger (10) is used to transfer a toner image visualized on the photoreceptor onto a transfer sheet (9). A pre-transfer charger (7) may be used to perform the transfer better. Suitable transferers include a transferer charger, an electrostatic transferer using a bias roller, an adhesion transferer, a mechanical transferer using a pressure and a magnetic transferer. The above-mentioned chargers can be used for the electrostatic transferer. Next, a separation charger (11) and a separation pick (12) are used to separate the transfer sheet (9) from the photoreceptor (1). Other separation means include an electrostatic absorption induction separator, a side-edge belt separator, a tip grip conveyor, a curvature separator, etc. The above-mentioned chargers can be used for the separation charger (11). Next, a fur brush (14) and a cleaning blade (15) are used to remove a toner left on the photoreceptor after transferred therefrom. A pre-cleaning charger (13) may be used to perform the cleaning more effectively. Other cleaners include a web cleaner, a magnet brush cleaner, etc., and these cleaners can be used alone or in combination. Next, a discharger is optionally used to remove a latent image in the photoreceptor. The discharger includes a discharge lamp (2) and a discharger, and the above-mentioned light sources and chargers can be used respectively. Known means can be used for other an original reading process, a paper feeding process, a fixing process, a paper delivering process, etc.

The above-mentioned image forming unit may be fixedly set in a copier, a facsimile or a printer. However, the image forming unit may detachably be set therein as a process cartridge.

Figure 3:
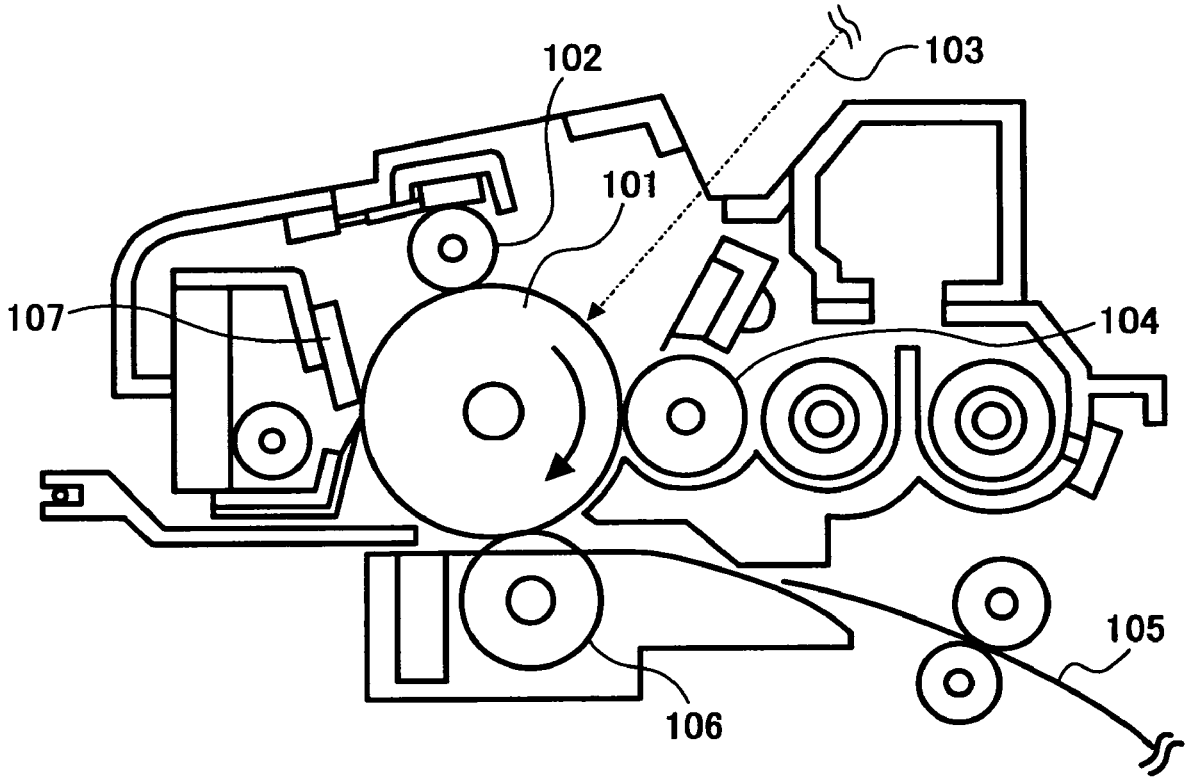
FIG. 3 is a schematic view illustrating a cross-section of an embodiment of the process cartridge for the image forming apparatus of the present invention.

FIG. 3 is a schematic view illustrating a cross-section of an embodiment of the process cartridge for the image forming apparatus of the present invention. The process cartridge is an image forming unit (or device) detachable from an image forming apparatus, including a photoreceptor (101) and at least one of a charger (102), an image developer (104), a transferer (106), a cleaner (107) and a discharger (not shown).

While the photoreceptor (101) rotates in a direction indicated by an arrow, the photoreceptor (101) is charged by the charger (102) and irradiated by an irradiator (103) to form an electrostatic latent image relevant to imagewise light thereon. The electrostatic latent image is developed by the image developer (104) with a toner to form a form a toner image, and the toner image is transferred by the transferer (106) onto a transfer sheet (105) to be printed out. Next, a surface of the photoreceptor after the toner image is transferred is cleaned by the cleaner (107), discharged by a discharger (not shown) and these processes are repeated.

As is apparent from the explanations mentioned above, the electrophotographic photoreceptor of the present invention can widely be used in electrophotography applied fields such as a laser beam printer, a CRT printer, a LED printer, a liquid crystal printer and a laser engraving.

<Preparation Example 1 Of Constituent (A)>

Preparation of 4,4'-dimethyltriphenylamine 18.63 g of aniline from TOKYO KASEI KOGYO Co., Ltd., 89.39 g of p-iodinetoluene, 66.34 g of kalium carbonate and 1.27 g of copper powder were mixed in a reaction reservoir having a mixer, a thermometer and a cooling pipe, and the mixture was subjected to a reaction at 210° C. for 25 hrs. The reacted liquid was diluted with 200 ml of cyclohexane after cooled, subjected to an absorption treatment with an active clay and silica gel, and condensed to prepare 29.82 g of a crystal of 4,4'-dimethyltriphenylamine, having a melting point of 109° C.

(Preparation of 4-bromo-4',4"-dimethyltriphenylamine)

14.53 g of 4,4'-dimethyltriphenylamine and 30 ml of dioxane were put in a reaction reservoir having a mixer, a thermometer and a dropping funnel, a liquid prepared by slowly dropping 9.34 g of bromine into 50 ml of dioxane at a room temperature was slowly dropped therein at a room temperature under a nitrogen stream, and further the mixture was subjected to a reaction at the same temperature for 1 hr. Then, 50 ml of toluene and 100 ml of water were added thereto to remove an organic layer.

The organic layer was washed with a sodium hydrogencarbonate solution and water, subjected to an absorption treatment and condensed to prepare 15.78 g of a crystal of 4-bromo-4',4"-dimethyltriphenylamine, having a melting point of from 102.0 to 103.0° C.

(Preparation of 4-methoxy-4'-N,N-di-p-tolylaminobiphenyl)

4.66 g of 4-bromo-4',4"-dimethyltriphenylamine, 2.04 g of 4-methoxyphenylboronic acid, 26 ml of toluene, 26 ml of a double-concentration kalium carbonate solution and 13 ml of ethanol were mixed in a reaction reservoir having a mixer, a thermometer and a dropping funnel. After the mixture was degassed with ultrasound under a nitrogen stream, 0.6 g of tetrakistriphenylphosphinepalladium were added thereto and the mixture was subjected to a reaction at 70° C. for 6 hrs. Then, an organic layer was removed therefrom, washed with water and condensed to prepare a crude material. The crude material was refined by column chromatography using silica gel, and further recrystallized with a mixed solvent of hexane and toluene to prepare 4.28 g of 4-methoxy-4'-N,N-di-p-tolylaminobiphenyl, having a melting point of from 142.0 to 142.5° C.

(Preparation of 4-hydroxy-4'-N,N-di-p-tolylaminobiphenyl)

15.2 of 4-methoxy-4'-N,N-di-p-tolylaminobiphenyl and 60 ml of methylenechloride were mixed in a reaction reservoir having a mixer, a thermometer and a dropping funnel, 26 ml of a methylenechloride solution of boron tribromide were dropped in the mixture while cooled with ice, and the mixture was subjected to a reaction at the same temperature for 4 hrs. Then, the reacted liquid was put in iced water, and methylene chloride was added thereto to abstract a crude material therefrom. The crude material was washed with a sodium hydrogencarbonate solution and water, and condensed to prepare 14.7 g of amorphous 4-hydroxy-4'-N,N-di-p-tolylaminobiphenyl.

The amorphous 4-hydroxy-4'-N,N-di-p-tolylaminobiphenyl had a positively-determined mass value of 366 per unit charge in accordance with the molecular weight +1 (proton addition) when ionized by an atmospheric pressure chemical ionization method.

(Preparation of 2-hydroxy-3-(4-(4'-N,N-di-p-tolylamino)biphenyloxy)propylmethacrylate)

6.0 g of 4-hydroxy-4'-N,N-di-p-tolylaminobiphenyl, 1.8 g of benzyltriethylammoniumchloride and 40 ml of tetrahydrofuran were mixed in a reaction reservoir having a mixer, a thermometer, cooling pipe and a dropping funnel, and a solution of 3.3 ml of glycidylmethacrylate and 10 ml of tetrahydrofuran was dropped in the mixture at a room temperature under a nitrogen stream. Then, the mixture was heated and refluxed for 40 hrs.

Figure 5:
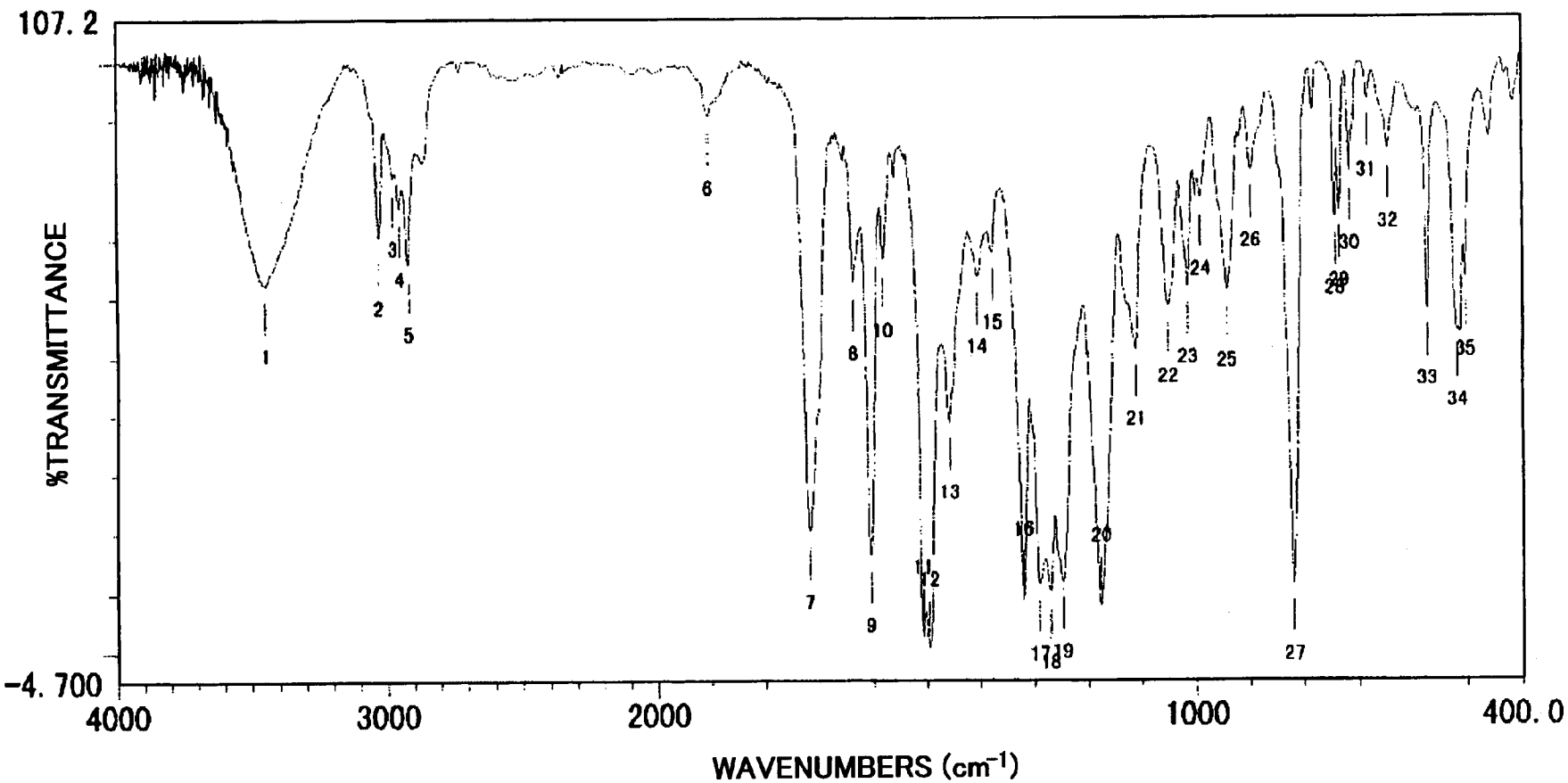
FIG. 5 is another embodiment of the IR measured data of the present invention.

Then, the mixture was diluted with ethylacetate, and passed through silica gel and solvents were removed therefrom to prepare 8 g of a crude material. The crude material was refined by column chromatography using silica gel and a solvent including hexane/ethylacetate (2/1) to prepare 1.5 g of an achromatic crystal of 2-hydroxy-3-(4-(4'-N,N-di-p-tolylamino)biphenyloxy)propylmethacrylate. IR measurement data thereof are shown in FIG. 5.

In addition, 3.5 g of an achromatic crystal by-product which is a mixture of 2-hydroxymethyl-2-(4-(4'-N,N-di-p-tolylamino)biphenyloxy)ethylmethacrylate having a constitution similar thereto and 2-hydroxy-3-(4-(4'-N,N-di-p-tolylamino)biphenyloxy)propylmethacrylate was obtained.

Figure 11:
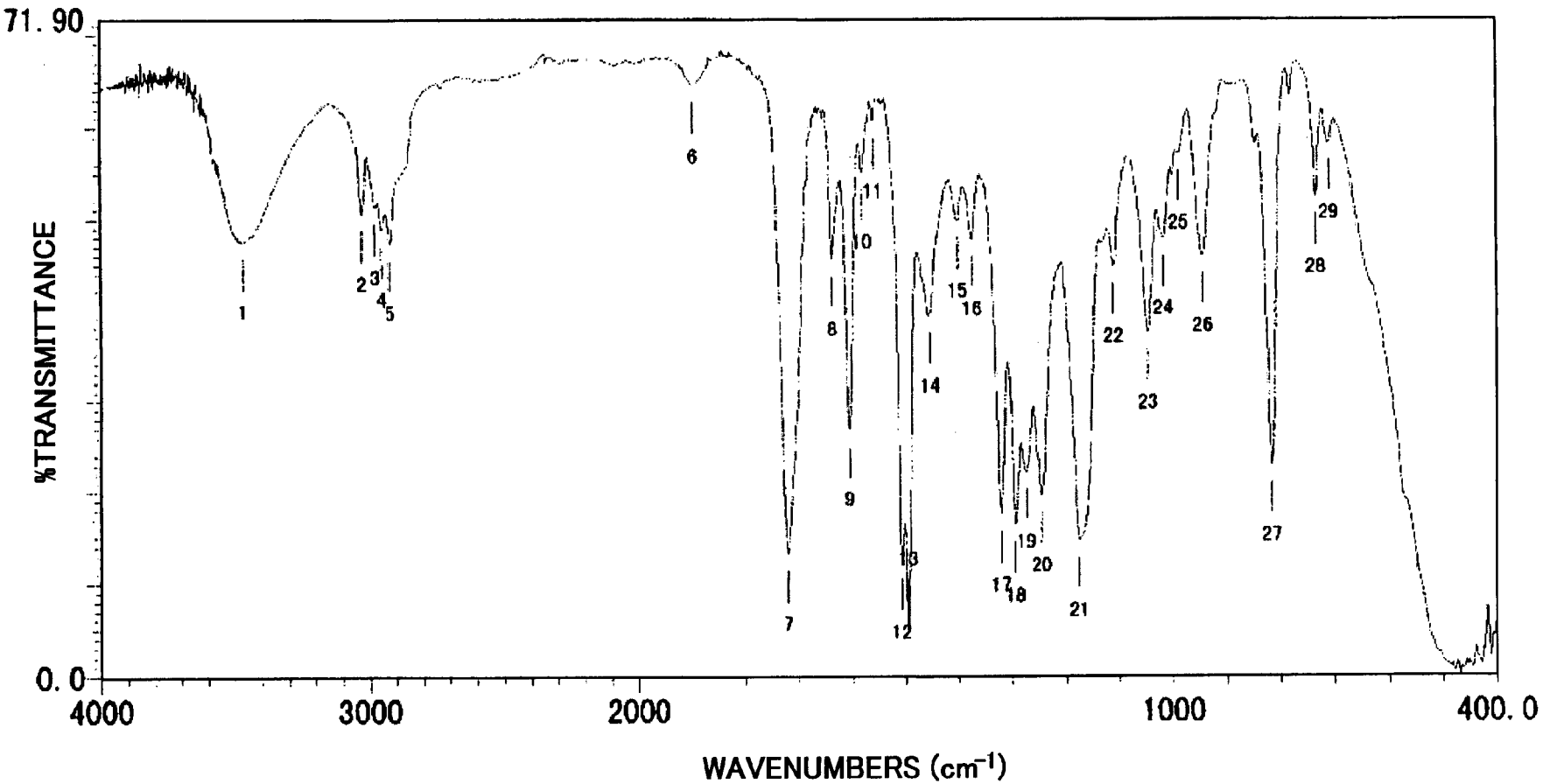
FIG. 11 is a further embodiment of the IR measured data of the present invention.

IR measurement data thereof are shown in FIG. 11.

Both of the 2-hydroxy-3-(4-(4'-N,N-di-p-tolylamino)biphenyloxy)propylmethacrylate and mixture with 2-hydroxymethyl-2-(4-(4'-N,N-di-p-tolylamino)biphenyloxy) ethylmethacrylate had positively-determined mass values of 508 per unit charge in accordance with the molecular weight +1 (proton addition) when ionized by an atmospheric pressure chemical ionization method.

(Preparation of The Exemplified Compound No. 2)

5.2 g of 2-hydroxy-3-(4-(4'-N,N-di-p-tolylamino)biphenyloxy)propylmethacrylate, 50 ml of tetrahydrofuran and 2 g of triethylamine were mixed in a reaction reservoir having a mixer, a thermometer and a dropping funnel, and a mixed solution including 1.9 g of acryloylchloride and 5 ml of tetrahydrofuran was dropped in the mixture at 15° C. under a nitrogen stream. Then, the mixture was subjected to a reaction at a room temperature for 5 hrs. Then, the mixture was diluted with 100 ml of toluene, and washed with water to obtain an organic layer. A condensed liquid thereof was subjected to column chromatography using silica gel and a solvent including hexane/ethylacetate (3/1) to prepare 3.1 g of an achromatic oil of the exemplified compound No. 2 obtained from the radical polymerizing monomer.

Figure 6:
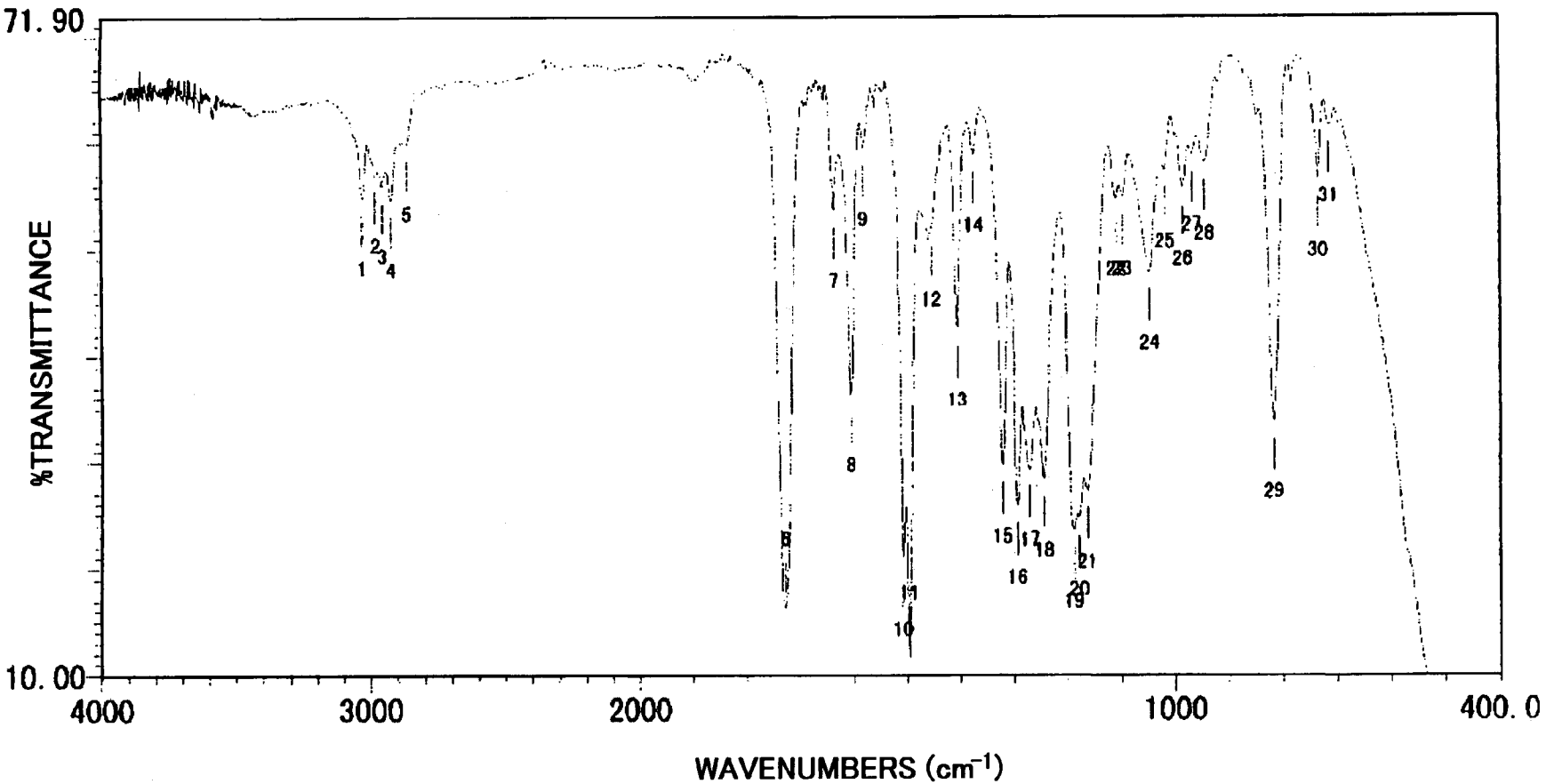
FIG. 6 is a further embodiment of the IR measured data of the present invention.

IR measurement data thereof are shown in FIG. 6.

The exemplified compound No. 2 had a positively-determined mass value of 562 per unit charge in accordance with the molecular weight +1 (proton addition) when ionized by an atmospheric pressure chemical ionization method.

As mentioned above, the other exemplified compounds can be prepared by converting 4,4'-dimethyltriphenylamine to various aniline derivatives.

In addition, the other exemplified compounds can be prepared from methoxy bodies equivalent to 4-methoxy-4'-N,N'-di-p-tolylaminobiphenyl, when subjected to the same reaction thereafter.

(Preparation Example 2 of Constituent (A)

Synthesis of a Mixture of the Exemplified Compound No. 2 and a Compound Having the Following Formula (13)

(13)

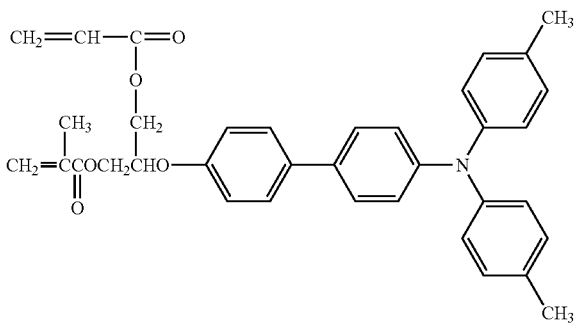

The procedure for preparation of the exemplified compound No. 2 was repeated except for using 3 g of a mixture of the 2-hydroxy-3-(4-(4'-N,N-di-p-tolylamino)biphenyloxy) propylmethacrylate and 2-hydroxymethyl-2-(4-(4'-N,N-di-p-tolylamino)biphenyloxy)ethylmethacrylate to prepare 2.86 g of an achromatic oil mixture.

Figure 7:
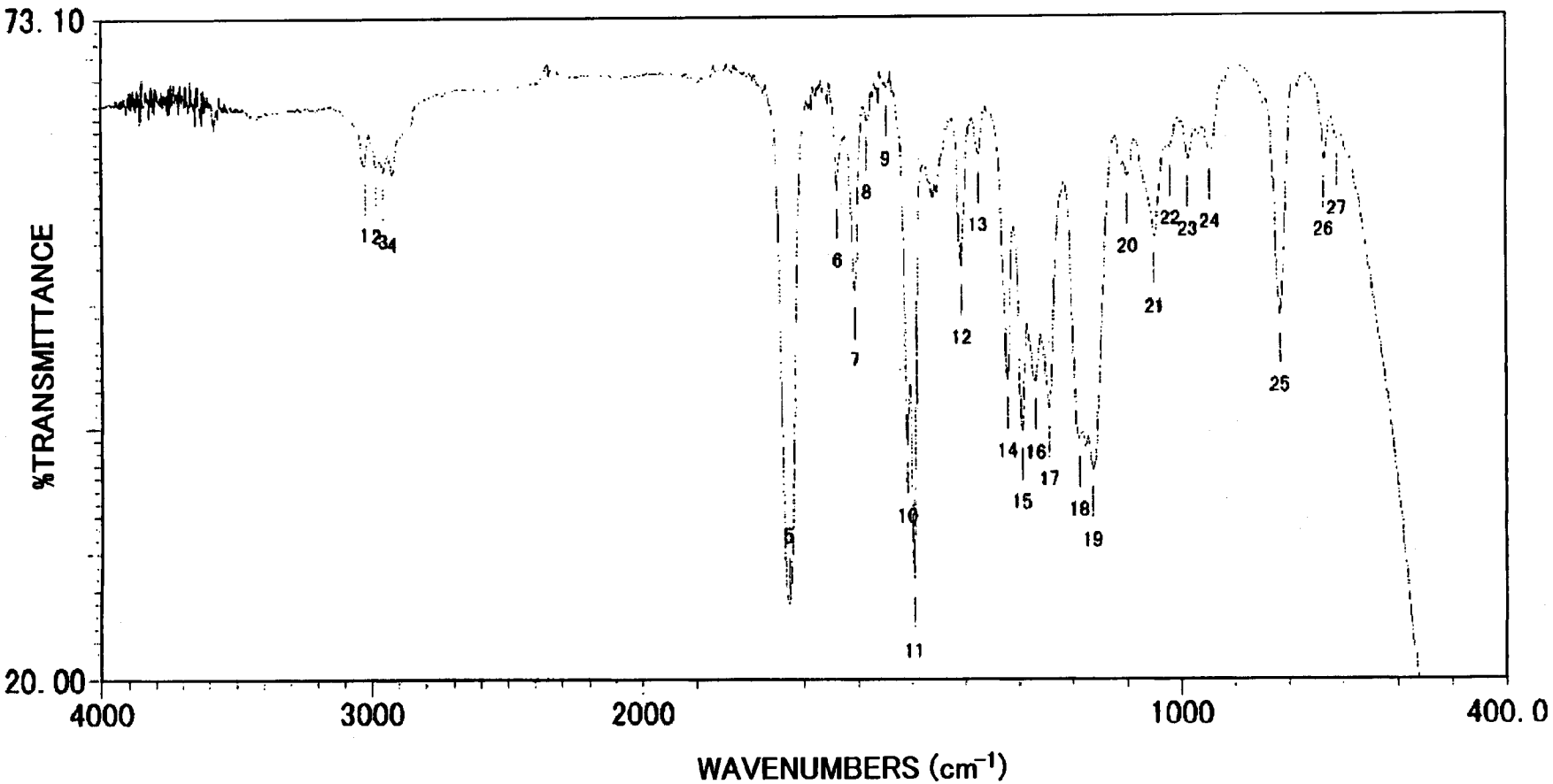
FIG. 7 is another embodiment of the IR measured data of the present invention.

IR measurement data thereof are shown in FIG. 7.

The achromatic oil mixture had a positively-determined mass value of 562 per unit charge in accordance with the molecular weight +1 (proton addition) when ionized by an atmospheric pressure chemical ionization method.

(Preparation Example 3 of Constituent (A)

Synthesis of a Compound Having the Following Formula (14))

(14)

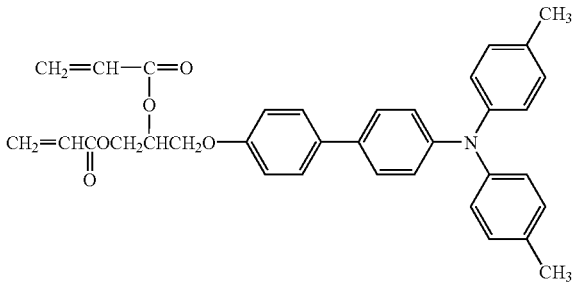

(Preparation of 1,2-dihydroxy-3-(4-(4'-N,N-di-p-tolylamino)biphenyloxy)propane)

5.0 g of 4-hydroxy-4'-N,N-di-p-tolylaminobiphenyl, an aqueous solution including 1.8 g of sodium hydrate an 8 g of water and 30 ml of tetrahydrofuran were mixed in a reaction reservoir having a mixer, a thermometer, cooling pipe and a dropping funnel, and a solution of 1.9 ml of glycidylmethacrylate and 10 ml of tetrahydrofuran was dropped in the mixture at a room temperature under a nitrogen stream. Then, the mixture was subjected to a reaction at 50° C. for 10 hrs.

Then, the mixture was diluted with ethylacetate, and washed with water and solvents were removed therefrom to prepare 7 g of a crude material. The crude material was refined by column chromatography using silica gel and a solvent including ethylacetate to prepare 4 g of an achromatic crystal of 1,2-dihydroxy-3-(4-(4'-N,N-di-p-tolylamino)biphenyloxy)propane having the following formula (15).

(15)

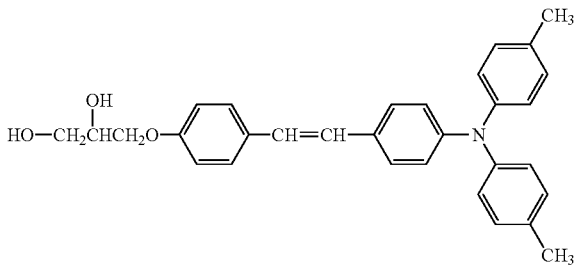

Figure 4:
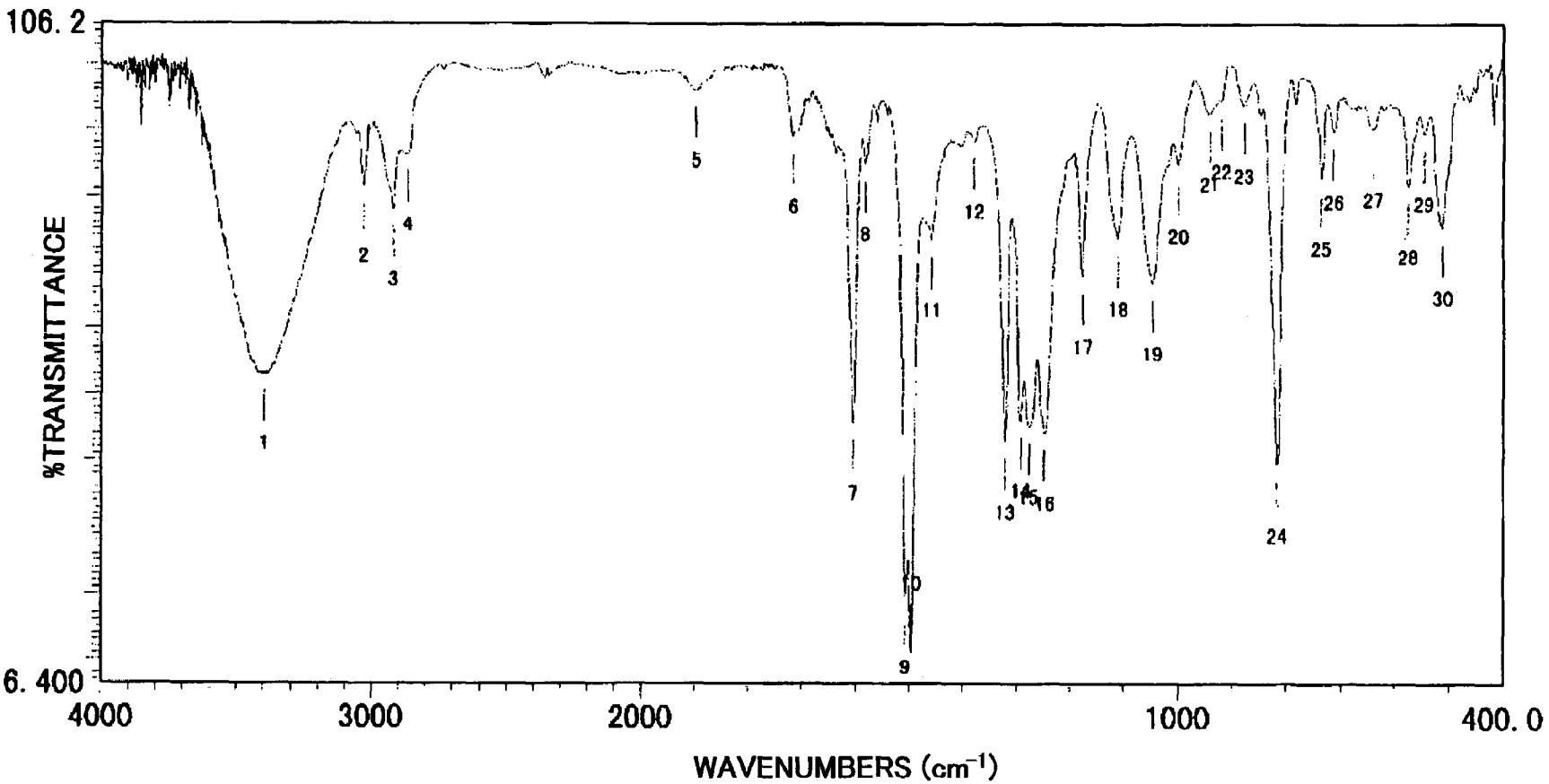
FIG. 4 is an embodiment of the IR measured data of the present invention.

IR measurement data thereof are shown in FIG. 4.

The 1,2-dihydroxy-3-(4-(4'-N,N-di-p-tolylamino)biphenyloxy)propane had a positively-determined mass value of 440 per unit charge in accordance with the molecular weight +1 (proton addition) when ionized by an atmospheric pressure chemical ionization method, and a melting point of from 136 to 147° C.

4.6 g of 1,2-dihydroxy-3-(4-(4'-N,N-di-p-tolylamino)biphenyloxy)propane, 20 ml of tetrahydrofuran and 5 g of triethylamine were mixed in a reaction reservoir having a mixer, a thermometer and a dropping funnel, and a mixed solution including 3.5 g of acryloylchloride and 5 ml of tetrahydrofuran was dropped in the mixture at 15° C. under a nitrogen stream. Then, the mixture was subjected to a reaction at a room temperature for 5 hrs. Then, the mixture was diluted with 100 ml of toluene, and washed with water to obtain an organic layer. A condensed liquid thereof was subjected to column chromatography using silica gel and a solvent including hexane/ethylacetate (3/1) to prepare 4.6 g of the compound having the formula (14).

Figure 8:
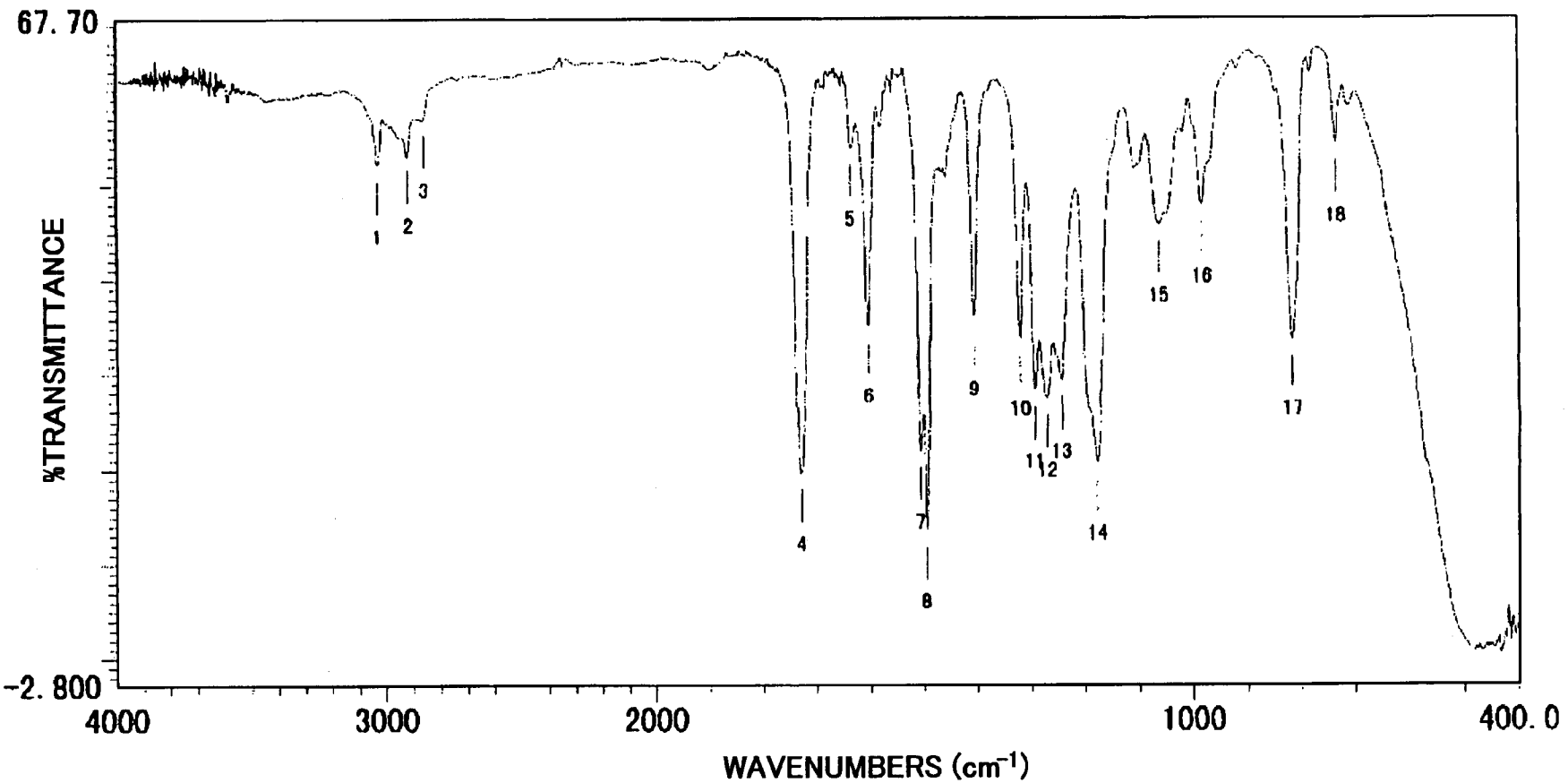
FIG. 8 is a further embodiment of the IR measured data of the present invention.

IR measurement data thereof are shown in FIG. 8.

The compound having the (14) had a positively-determined mass value of 548 per unit charge in accordance with the molecular weight +1 (proton addition) when ionized by an atmospheric pressure chemical ionization method.

<Preparation Example 4 of Constituent (A)>

Synthesis of a Compound Having the Following Formula (16)

(16)

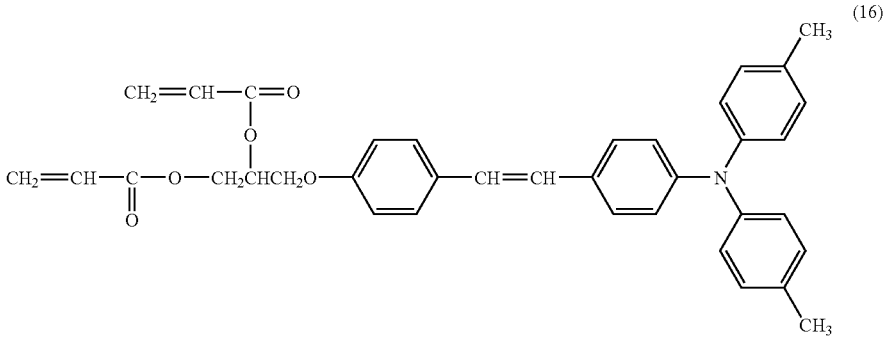

(Preparation of 4-methoxybenzyldiethylphosphonate)

4-methoxybenzylchloride and triethylphosphite were subjected to a reaction at 150° C. for 5 hrs. Then, the reaction product was subjected to reduced-pressure distillation for removing the excessive triethylphosphite and a by-product, ethylchloride, to prepare 4-methoxybenzyldiethylphosphonate.

The 4-methoxybenzyldiethylphosphonate had a positively-determined mass value of 259 per unit charge in accordance with the molecular weight +1 (proton addition) when ionized by an atmospheric pressure chemical ionization method.

(Preparation of 4-methoxy-4'-(di-p-tolylamino)stilbene)

Equivalent molecular weight of the 4-methoxybenzyldiethylphosphonate and 4-(di-p-tolylamino)benzaldehyde were dissolved in N,N-dimethylformaldehyde, and tert-butoxy kalium was gradually added in the solution while stirred and cooled with water. After the solution was stirred at a room temperature for 5 hrs, water was added thereto for acidifying the solution to precipitate a crude material. The crude material was further refined by column chromatography using silica gel to prepare 4-methoxy-4'-(di-p-tolylamino)stilbene.

The 4-methoxy-4'-(di-p-tolylamino)stilbene had a positively-determined mass value of 406 per unit charge in accordance with the molecular weight +1 (proton addition) when ionized by an atmospheric pressure chemical ionization method, and a melting point of from 157 to 157.5° C.

(Preparation of 4-hydroxy-4'-(di-p-tolylamino)stilbene)

The 4-methoxy-4'-(di-p-tolylamino)stilbene and a double equivalent weight of sodiumethane thiolate were dissolved in N,N-dimethylformaldehyde, and the solution was subjected to a reaction at 130° C. for 5 hrs. Then, the solution was cooled, put in water, neutralized with hydrochloric acid, and an extract was extracted with ethylacetate. The extract was washed with water, dried and solvents were removed therefrom to prepare a crude material. The crude material was further refined by column chromatography using silica gel to prepare 4-hydroxy-4'-(di-p-tolylamino)stilbene.

The 4-hydroxy-4'-(di-p-tolylamino)stilbene had a positively-determined mass value of 392 per unit charge in accordance with the molecular weight +1 (proton addition) when ionized by an atmospheric pressure chemical ionization method, and a melting point of from 152 to 155° C.

(Preparation of 1,2-dihydroxy-3-[4'-(di-p-tolylamino)stilbene-4-yloxy]propane)

11.75 g of the 4-hydroxy-4'-(di-p-tolylamino)stilbene, 4.35 g of glycidylmethacrylate, 8 ml of toluene were mixed in a reaction reservoir having a mixer, a thermometer, cooling pipe and a dropping funnel. After the mixture was heated to have a temperature of 90° C., 0.16 g of triethylamine was added thereto and stirred while heated at 95° C. for 8 hrs.

Then, the mixture was diluted with ethylacetate, and washed with an acid and water, and solvents were removed therefrom to prepare 19 g of a crude material. The crude material was refined by column chromatography using silica gel and a solvent including ethylacetate to prepare 9.85 g of a yellow crystal of 1,2-dihydroxy-3-[4'-(di-p-tolylamino)stilbene-4-yloxy]propane having the following formula (17) and a melting point of from 127 to 128° C.

(17)

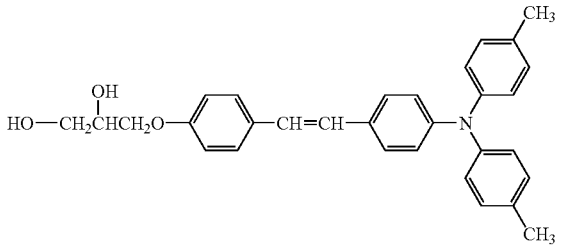

Figure 9:
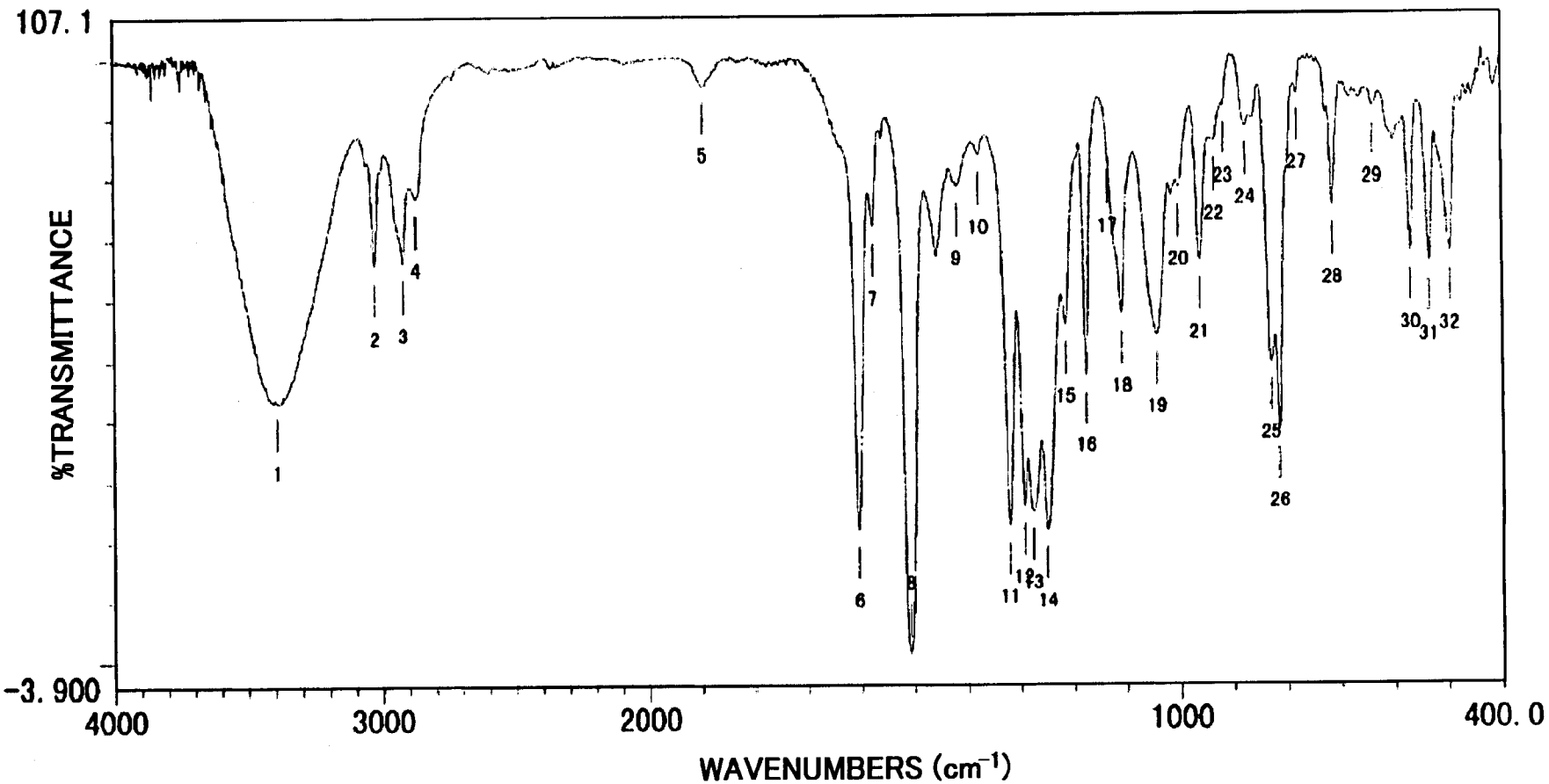
FIG. 9 is another embodiment of the IR measured data of the present invention.

IR measurement data thereof are shown in FIG. 9.

The 1,2-dihydroxy-3-[4'-(di-p-tolylamino)stilbene-4-yloxy]propane had a positively-determined mass value of 466 per unit charge in accordance with the molecular weight +1 (proton addition) when ionized by an atmospheric pressure chemical ionization method.

1.0 g of 1,2-dihydroxy-3-[4'-(di-p-tolylamino)stilbene-4-yloxy]propane, 10 ml of N,N-dimethylacetamide were mixed in a reaction reservoir having a mixer, a thermometer and a dropping funnel, and 1.0 g of 3-chloropropanate chloride was dropped in the mixture at 3° C. under a nitrogen stream. Then, the mixture was subjected to a reaction at a room temperature for 8 hrs. Next, 1.74 g of triethylamine was added thereto and the mixture was subjected to a reaction at 60° C. for 4 hrs. Then, the mixture was diluted with methylenechloride, and washed with water to obtain an organic layer. A condensed liquid thereof was refined by column chromatography using silica gel and a solvent including hexane/ethylacetate (2/1) to prepare 1.1 g of a yellow oil of the compound having the formula (16).

Figure 10:
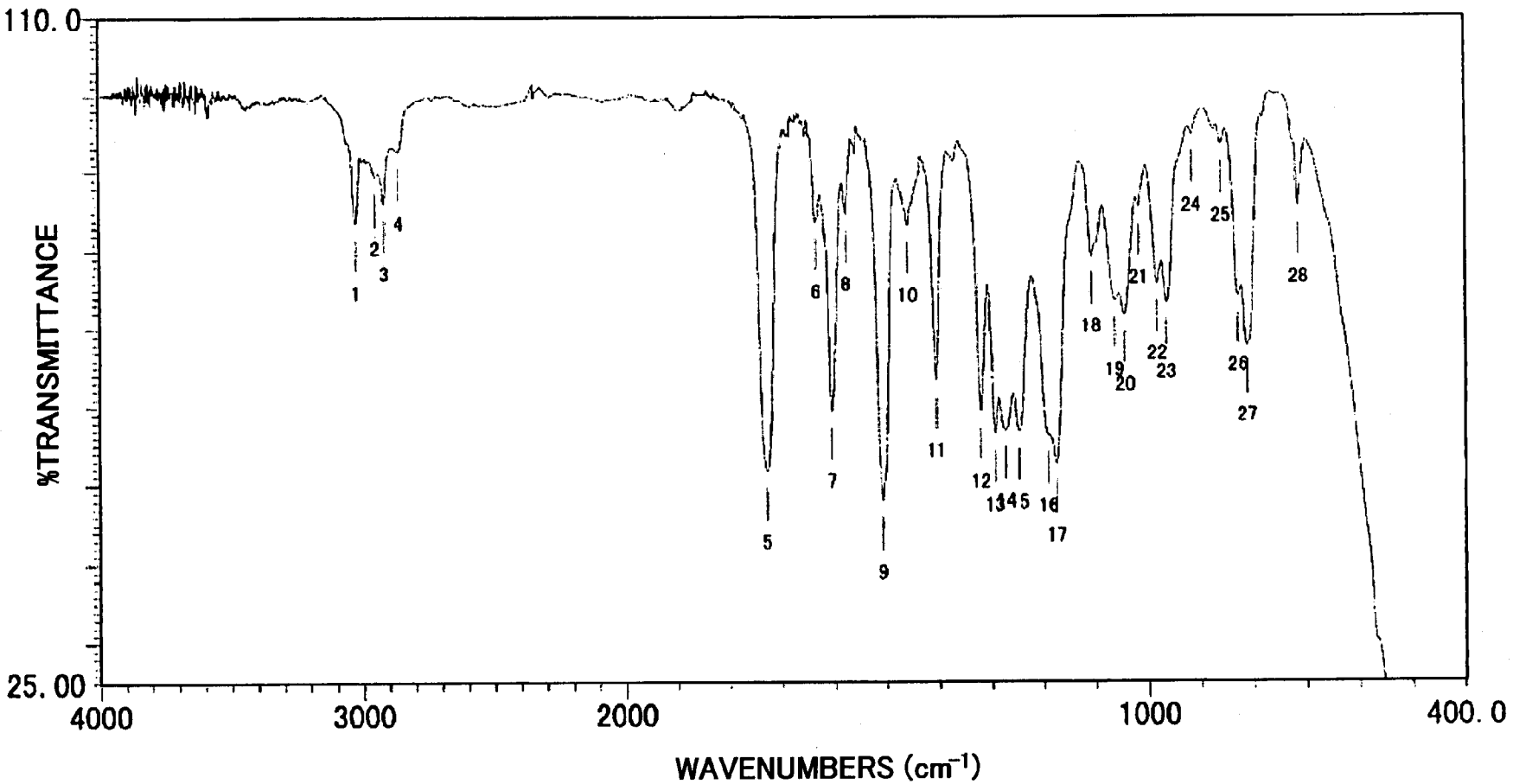
FIG. 10 is a further embodiment of the IR measured data of the present invention.

IR measurement data thereof are shown in FIG. 10.

The compound having the (16) had a positively-determined mass value of 574 per unit charge in accordance with the molecular weight +1 (proton addition) when ionized by an atmospheric pressure chemical ionization method.

As mentioned above, the other exemplified compounds can be prepared by reacting 4-methoxybenzyldiethylphosphonate or its derivatives with various benzaldehyde derivatives to synthesize 4-methoxystilbene derivatives, and then subjecting them to the same reaction thereafter.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

An undercoat coating liquid, a charge generation coating liquid and charge transport coating liquid, which have the following formulations, were coated and dried in this order on an aluminum cylinder having a diameter of 30 mm to form an undercoat layer 3.5 μm thick, a CGL 0.2 μm thick, a CTL 18 μm thick thereon.

| Undercoat layer coating liquid | |
|---|---|
| Alkyd resin (BEKKOZOL1307-60-EL from Dainippon Ink & Chemicals, Inc.) | 6 |
| Melamine resin (SUPER BEKKAMIN G-821-60 from Dainippon Ink & Chemicals, Inc.) | 4 |
| Titanium dioxide powder | 40 |
| Methyl ethyl ketone | 50 |

| CTL coating liquid | |
|---|---|
| Bisphenol Z Polycarbonate (Panlite TS-2050 from TEIJIN CHEMICALS LTD.) | 10 |
| Low-molecular-weight charge transport material having the following formula (II): | 7 |

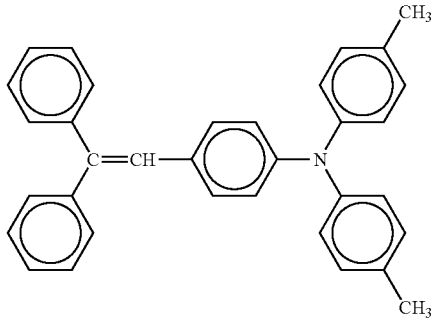

(II)

| | |
|---|---|
| Tetrahydrofuran | 100 |
| tetrahydrofuran solution including silicone oil in an amount of 1% by weight (KF50-100CS from Shin-Etsu Chemical Industry Co., Ltd.) | 0.2 |

| CGL coating liquid | |
|---|---|
| Bisazo pigment having the following formula (I): | 2.5 |

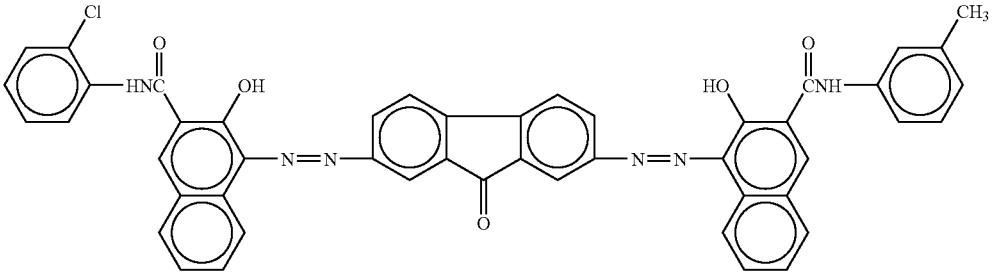

(I)

| | |
|---|---|
| Polyvinyl butyral (XYHL from Union Carbide Corp.) | 0.5 |
| Cyclohexanone | 200 |
| Methyl ethyl ketone | 80 |

The CTL was further coated with a crosslinked CTL coating liquid having the following formulation by a spray coating method.

| Crosslinked CTL coating liquid | |
|---|---|
| Constituent A<br>Exemplified Compound No. 2 | 10 |
| Constituent B<br>Trimethylolpropanetriacrylate<br>KAYARAD TMPTA from NIPPON KAYAKU CO., LTD., having a molecular weight of 296, 3 functional groups and a ratio of the molecular weigh to the number of functional groups of 99 | 10 |
| Constituent C<br>1-hydroxy-cyclohexyl-phenyl-ketone<br>IRGACURE 184 from CIBA SPECIALTY CHEMICALS | 1 |
| Tetrahydrofuran | 100 |

After naturally dried for 20 min, the crosslinked CTL was irradiated by a metal halide lamp at 160 W/cm, an irradiation distance of 110 mm and an irradiation intensity of 750 mW/cm$^2$ for 240 sec to be hardened. The crosslinked CTL was further dried at 130° C. for 20 min to prepare an electrophotographic photoreceptor of the present invention, having a crosslinked CTL 5.0 μm thick.

Example 2

The procedure for preparation of the electrophotographic photoreceptor in Example 1 was repeated to prepare an electrophotographic photoreceptor except for replacing the component A with a mixture of the Exemplified Compound No. 2 and the compound having the formula (13).

Example 3

The procedure for preparation of the electrophotographic photoreceptor in Example 1 was repeated to prepare an electrophotographic photoreceptor except for replacing the component A with the compound having the formula (14).

Example 4

The procedure for preparation of the electrophotographic photoreceptor in Example 3 was repeated to prepare an electrophotographic photoreceptor except for forming a crosslinked CTL 1 μm thick thereon.

Example 5

The procedure for preparation of the electrophotographic photoreceptor in Example 3 was repeated to prepare an electrophotographic photoreceptor except for forming a crosslinked CTL 2 μm thick thereon.

Example 6

The procedure for preparation of the electrophotographic photoreceptor in Example 3 was repeated to prepare an electrophotographic photoreceptor except for forming a crosslinked CTL 7 μm thick thereon.

Example 7

The procedure for preparation of the electrophotographic photoreceptor in Example 3 was repeated to prepare an electrophotographic photoreceptor except for forming a crosslinked CTL 10 μm thick thereon.

Example 8

The procedure for preparation of the electrophotographic photoreceptor in Example 3 was repeated to prepare an electrophotographic photoreceptor except for forming a crosslinked CTL 12 μm thick thereon.

Example 9

The procedure for preparation of the electrophotographic photoreceptor in Example 1 was repeated to prepare an electrophotographic photoreceptor except for replacing the component A with the compound having the formula (16).

Comparative Example 1

The procedure for preparation of the electrophotographic photoreceptor in Example 1 was repeated to prepare an electrophotographic photoreceptor except for replacing the component A with a compound having the following formula (18):

(18)

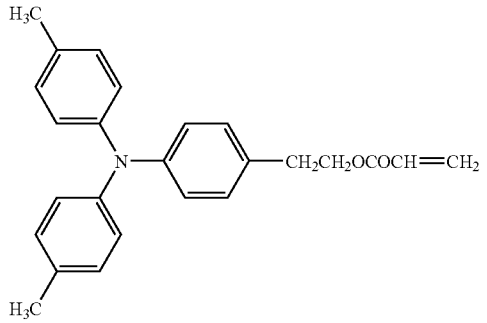

Comparative Example 2

The procedure for preparation of the electrophotographic photoreceptor in Example 1 was repeated to prepare an electrophotographic photoreceptor except for replacing the component A with a compound having the following formula (19):

(19)

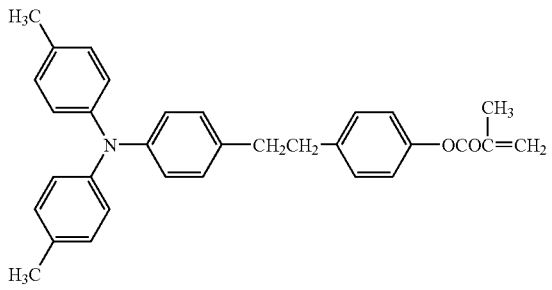

Comparative Example 3

The procedure for preparation of the electrophotographic photoreceptor in Example 1 was repeated to prepare an electrophotographic photoreceptor except for replacing the component A with a compound having the following formula (20):

(20)

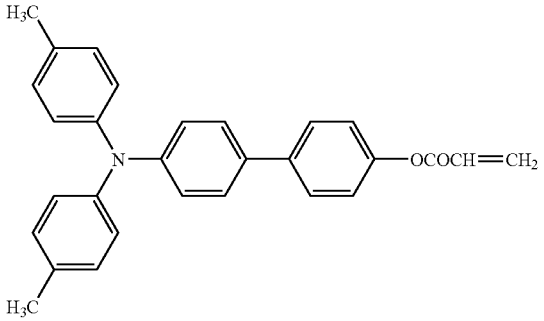

Comparative Example 4

The procedure for preparation of the electrophotographic photoreceptor in Example 1 was repeated to prepare an electrophotographic photoreceptor except for replacing the component A with a compound having the following formula (21):

(21)

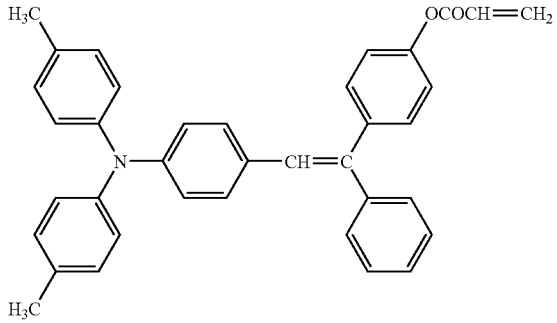

Comparative Example 5

The procedure for preparation of the electrophotographic photoreceptor in Example 1 was repeated to prepare an electrophotographic photoreceptor except for replacing the component A with a compound having the following formula (22):

(22)

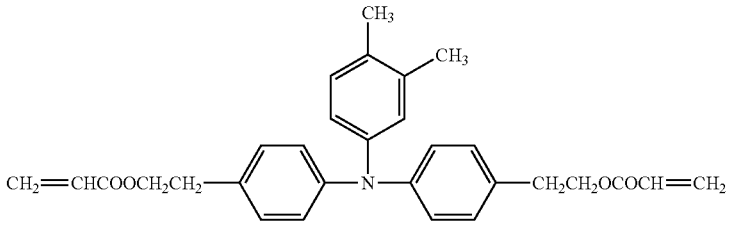

Comparative Example 6

The procedure for preparation of the electrophotographic photoreceptor in Example 1 was repeated to prepare an electrophotographic photoreceptor except for replacing the component A with a compound having the following formula (23):

(23)

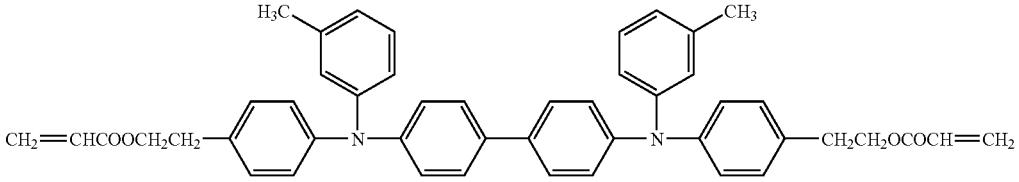

Comparative Example 7

The procedure for preparation of the electrophotographic photoreceptor in Example 1 was repeated to prepare an electrophotographic photoreceptor except for replacing the component A with a compound having the following formula (24):

(24)

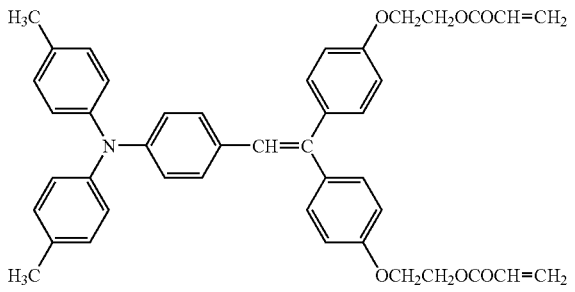

Comparative Example 8

The procedure for preparation of the electrophotographic photoreceptor in Example 1 was repeated to prepare an electrophotographic photoreceptor except for replacing the component A with a compound having the following formula (25):

(25)

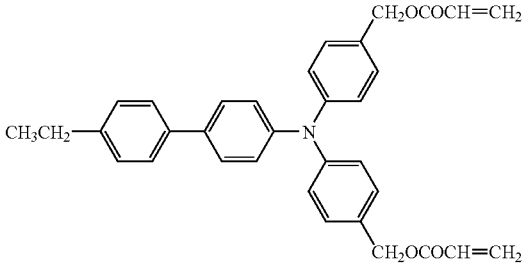

The appearance of each electrophotographic photoreceptor prepared in Examples 1 to 9 and Comparative Examples 1 to 8 was visually observed to see whether it had a crack or a film peeling. In addition, the gel fraction of each crosslinked CTL was measured. Each crosslinked CTL was directly formed on the aluminum substrate under the same conditions in respective Examples and Comparative Examples, which were dipped in tetrahydrofuran at 25° C. for 5 days and the weight residual rate of a gel was determined as the gel fraction. The results are shown in Table 1.

TABLE 1

| | Thickness of crosslinked CTL (μm) | Surface appearance | Gel fraction (%) |
|---|---|---|---|
| Example 1 | 5.0 | Good | 98 |
| Example 2 | 5.0 | Good | 98 |
| Example 3 | 5.0 | Good | 99 |
| Example 4 | 1.0 | Good | 98 |
| Example 5 | 3.0 | Good | 99 |
| Example 6 | 7.0 | Good | 99 |

TABLE 1-continued

| | Thickness of crosslinked CTL (μm) | Surface appearance | Gel fraction (%) |
|---|---|---|---|
| Example 7 | 10.0 | Good | 98 |
| Example 8 | 12.0 | Good | 94 |
| Example 9 | 5.0 | Good | 99 |
| Comparative Example 1 | 5.0 | Good | 95 |
| Comparative Example 2 | 5.0 | Good | 93 |
| Comparative Example 3 | 5.0 | Good | 95 |
| Comparative Example 4 | 5.0 | Good | 90 |
| Comparative Example 5 | 5.0 | Cracked | 97 |
| Comparative Example 6 | 5.0 | Good | 96 |
| Comparative Example 7 | 5.0 | Good | 94 |
| Comparative Example 8 | 5.0 | Good | 96 |

Next, each of the photoreceptors prepared in Examples 1 to 9 and Comparative Examples 1 to 8, except for the photoreceptor which had a crack in Comparative Example 5, was installed in a process cartridge for an electrophotographic image forming apparatus, and the process cartridge was set in a modified imagio Neo 270 from Ricoh Company, Ltd., using a laser diode having a wavelength of 655 nm as an imagewise light source, wherein the initial dark space potential was −700 V. A4-sized 100,000 images were produced thereby with a toner including silica as an external additive, and the initial layer thickness of the photoreceptor and that after 50,000 images were produced were measured to determine an abraded amount thereof. The image after 50,000 images were produced was observed and the number of white spots per unit area thereof was counted. In addition, the initial irradiated part potential (VL) and that w after 50,000 images were produced were measured to see the residual potential. The results are shown in Table 2.

TABLE 2

| | The image after 50,000 images were produced | Abraded amount (μm) | The number of white spots (piece/100 $cm^2$) | Initial VL | VL after 50,000 |
|---|---|---|---|---|---|
| Example 1 | Good | 0.6 | 0 to 5 | 85 | 120 |
| Example 2 | Good | 0.6 | 0 to 5 | 85 | 120 |
| Example 3 | Good | 0.6 | 0 to 5 | 85 | 120 |
| Example 4 | Background fouling slightly occurred | 0.9 | 0 to 5 | 85 | 120 |
| Example 5 | Good | 0.6 | 0 to 5 | 85 | 120 |
| Example 6 | Good | 0.6 | 0 to 5 | 85 | 120 |
| Example 7 | Good | 0.6 | 0 to 5 | 90 | 165 |
| Example 8 | Image density slightly lowered | 0.6 | 0 to 5 | 100 | 180 |
| Example 9 | Good | 0.5 | 0 to 5 | 85 | 110 |
| Comparative Example 1 | Image density largely lowered | 1.3 | 10 to 20 | 180 | 250 |
| Comparative Example 2 | Image density largely lowered | 2.1 | 10 to 20 | 180 | 230 |
| Comparative Example 3 | Good | 1.2 | 10 to 20 | 85 | 120 |

TABLE 2-continued

| | The image after 50,000 images were produced | Abraded amount (μm) | The number of white spots (piece/100 $cm^2$) | Initial VL | VL after 50,000 |
|---|---|---|---|---|---|
| Comparative Example 4 | Background fouling occurred | 2.7 | 10 to 20 | 85 | 115 |
| Comparative Example 6 | Image density slightly lowered | 0.8 | 0 to 5 | 120 | 195 |
| Comparative Example 7 | Image density largely lowered | 1.0 | 0 to 5 | 120 | 200 |
| Comparative Example 8 | Image density largely lowered | 0.8 | 0 to 5 | 150 | 240 |

As seen from the results in Table 2, the electrophotographic photoreceptor of the present invention has good abrasion resistance and produces less-defective images. Particularly, the electrophotographic photoreceptor produces images having less white spots caused by silica stuck thereon and stably produce good images even when used for long periods.

This is apparently due to the constituent (A) for use in the present invention, and an electrophotographic photoreceptor having coated and hardened constituents formed from radical-polymerized constituent (A) at the surface thereof has good properties.

Particularly, a combination of the constituent (A) and constituent (B) forms a highly-durable photoreceptor having a smooth surface, quite good abrasion resistance, low residual potential, and producing less defective images such as white spots. In addition, the coated and hardened constituents are effectively hardened under the presence of a photopolymerization initiator.

Further, the coated and hardened constituents preferably form a crosslinked CTL having a thickness of from 1 to 10 μm. When less than 1 μm, there leaves little room after 50,000 images are produced. When thicker than 10 μm, the gel fraction lowers, resulting in increase of residual potential.

Furthermore, the constituent (A) having the formula (4) or (5) is more preferably used for highest abrasion resistance, good potential stability and less white spots.

This application claims priority and contains subject matter related to Japanese Patent Applications Nos. 2004-373101, 2005-141686 and 2005-164996, filed on Dec. 24, 2004, May 13, 2005 and Jun. 6, 2005 respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor, comprising:

an electroconductive substrate; and a photosensitive layer located overlying the electroconductive substrate, wherein the photosensitive layer comprises units obtained from a radical polymerizing monomer at a surface thereof, wherein the radical polymerizing monomer comprises (i) an aliphatic group portion of formula (1)

(1)

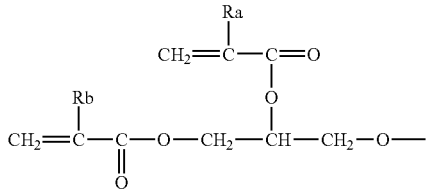

wherein Ra and Rb each, independently, represent a hydrogen atom or a methyl group, and (ii) a hole transporting group portion including no radical polymerizing group selected from the group consisting of a vinyl group, an allyl group, an acryloyloxy group, a methacaryloyloxy group and an acrylamide group, wherein the aliphatic group portion (i) and the hole transporting group portion (ii) are connected to each other by a single bond.

2. The electrophotographic photoreceptor of claim 1, wherein the photosensitive layer further comprises units obtained from a radical polymerizing monomer having three or more radical polymerizing groups within a molecule.

3. The electrophotographic photoreceptor of claim 2, wherein the photosensitive layer further comprises a photo polymerization initiator.

4. The electrophotographic photoreceptor of claim 1, wherein the radical polymerizing monomer has the following formula (2):

(2)

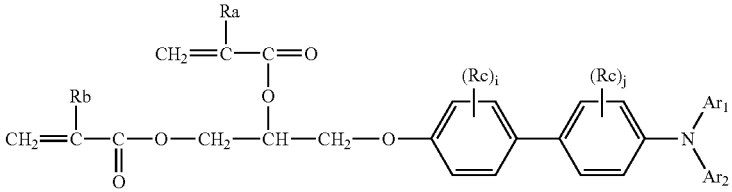

wherein Ra and Rb each, independently, represent a hydrogen atom or a methyl group; Rc and Rd each, independently, represent an alkyl group having 1 to 6 carbon atoms and optionally having a substituent, an alkoxy group optionally having a substituent or an aryl group optionally having a substituent, or Rc and Rd are combined with each other to form a cyclic hydrocarbon ring having 5 to 8 carbon atoms; $Ar_1$ and $Ar_2$ each, independently, represent an aryl group optionally having a substituent; and i and j each, independently, represent 0 or an integer of from 1 to 4.

5. The electrophotographic photoreceptor of claim 1, wherein the radical polymerizing monomer has the following formula (3):

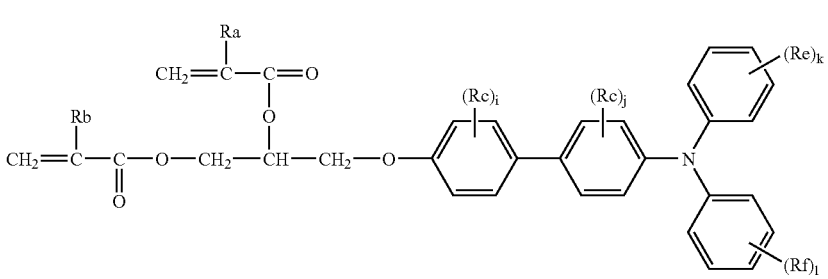

(3)

wherein Ra and Rb each, independently, represent a hydrogen atom or a methyl group; Rc, Rd, Re and Rf each, independently, represent an alkyl group having 1 to 6 carbon atoms and optionally has a substituent, an alkoxy group optionally having a substituent or an aryl group optionally having a substituent, or Rc and Rd are combined with each other to form a cyclic hydrocarbon ring having 5 to 8 carbon atoms; $Ar_1$ and $Ar_2$ each, independently, represent an aryl group optionally having a substituent; i and j each, independently, represent 0 or an integer of from 1 to 4; and k and 1 each, independently, represent 0 or an integer of from 1 to 5.

6. The electrophotographic photoreceptor of claim 1, wherein the radical polymerizing monomer has the following formula (4):

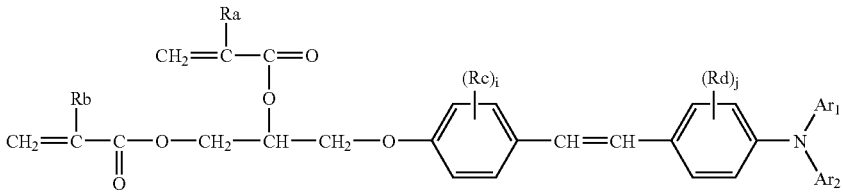

(4)

wherein Ra and Rb each, independently, represent a hydrogen atom or a methyl group; Rc and Rd each, independently, represent an alkyl group having 1 to 6 carbon atoms optionally having a substituent, an alkoxy group optionally having a substituent or an aryl group optionally having a substituent, or Re and Rd are combined with each other to form a cyclic hydrocarbon ring having 5 to 8 carbon atoms; $Ar_1$ and $Ar_2$ each, independently, represent an aryl group optionally having a substituent; and i and j each, independently, represent 0 or an integer of from 1 to4.

7. The electrophotographic photoreceptor of claim 1, wherein the radical polymerizing monomer has the following formula (5):

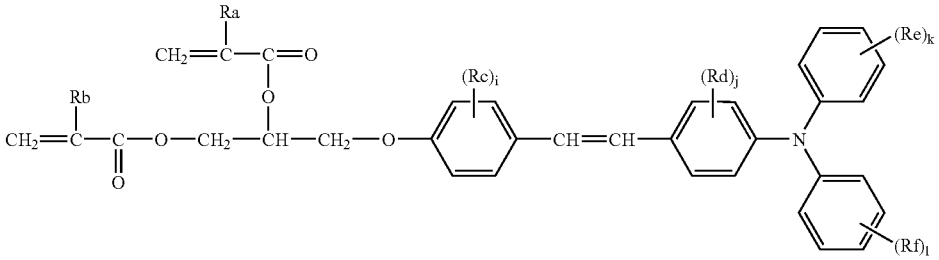

(5)

wherein Ra and Rb each, independently, represent a hydrogen atom or a methyl group; Rc, Rd, Re and Rf each, independently, represent an alkyl group having 1 to 6 carbon atoms optionally having a substituent, an alkoxy group optionally having a substituent or an aryl group optionally having a substituent; $Ar_1$ and $Ar_2$ each, independently, represent an aryl group optionally having a substituent; i and j each, independently, represent 0 or an integer of from 1 to 4; and k and l each, independently, represent 0 or an integer of from 1 to 5.

8. The electrophotographic photoreceptor of claim 1, wherein the photosensitive layer further comprises:

a charge generation layer, located overlying the electroconductive substrate;

a charge transport layer, located overlying the charge generation layer; and a crosslinked charge transport layer, located overlying the charge transport layer;

wherein the crosslinked charge transport layer comprises units obtained from a radical polymerizing monomer, wherein the radical polymerizing monomer comprises an aliphatic group having two radical polymerizing groups and a charge transporting group including no radical polymerizing group, connected to each other by a single bond.

9. The electrophotographic photoreceptor of claim 8, wherein the crosslinked charge transport layer further comprises units obtained from a radical polymerizing monomer having three or more radical polymerizing groups within a molecule.

10. The electrophotographic photoreceptor of claim 9, wherein the crosslinked charge transport layer further comprises a photo polymerization initiator.

11. The electrophotographic photoreceptor of claim 8, wherein the crosslinked charge transport layer has a thickness of from 1 to 10 μm.

12. The electrophotographic photoreceptor of claim 8, wherein the crosslinked charge transport layer is insoluble in an organic solvent.

13. The electrophotographic photoreceptor of claim 9, wherein a ratio of a molecular weight of the units obtained from a radical polymerizing monomer having three or more radical polymerizing groups within a molecule to the number of radical polymerizing functional groups is not greater than 250.

14. An image forming method, comprising:

charging the electrophotographic photoreceptor according to claim 1;

irradiating the electrophotographic photoreceptor to form an electrostatic latent image thereon;

developing the electrostatic latent image with a toner to form a toner image thereon; and transferring the toner image onto a receiving material.

15. An image forming apparatus, comprising:

the electrophotographic photoreceptor according to claim 1;

a charger configured to charge the electrophotographic photoreceptor;

an irradiator configured to irradiate the electrophotographic photoreceptor to form an electrostatic latent image thereon;

an image developer configured to develop the electrostatic latent image with a toner to form a toner image thereon; and a transferer configured to transfer the toner image onto a receiving material.

16. A process cartridge detachable from an image forming apparatus, comprising:

the electrophotographic photoreceptor according to claim 1; and at least one member selected from the group consisting of a charger, an image developer, a transferer, a cleaner and a discharger.

* * * * *